US005458182A

United States Patent [19]

Aoki et al.

[11] Patent Number: 5,458,182

[45] Date of Patent: Oct. 17, 1995

[54] MOLD VIBRATING APPARATUS IN CONTINUOUS CASTING EQUIPMENT

[75] Inventors: Masato Aoki, Ibaraki; Shigeharu Okumura, Higashiosaka; Motomitsu Suzuki, Mino; Kyoji Chikira, Takatsuki; Toshiyuki Okada, Kobe; Katsuya Sasaki, Hirakata; Yoichiro Nakamura, Suita; Hideki Saito, Kawachinagano, all of Japan

[73] Assignee: Hitachi Zosen Corporation, Osaka, Japan

[21] Appl. No.: 323,134

[22] Filed: Oct. 14, 1994

[30] Foreign Application Priority Data

| | | | |
|---|---|---|---|
| Oct. 21, 1993 | [JP] | Japan | 5-263200 |
| Oct. 21, 1993 | [JP] | Japan | 5-263201 |
| Feb. 28, 1994 | [JP] | Japan | 6-029229 |
| Feb. 28, 1994 | [JP] | Japan | 6-029230 |

[51] Int. Cl.[6] ..... B22D 11/04; B22D 11/16

[52] U.S. Cl. ..... 164/154.2; 164/478; 164/416

[58] Field of Search ..... 164/478, 416, 164/452, 154.2, 154.1

[56] References Cited

U.S. PATENT DOCUMENTS

| | | | |
|---|---|---|---|
| 4,577,277 | 3/1986 | Kamei et al. | 364/472 |
| 4,703,789 | 11/1987 | Reichelt et al. | 164/416 |
| 5,350,005 | 9/1994 | Sorimachi et al. | 164/416 |

FOREIGN PATENT DOCUMENTS

| | | |
|---|---|---|
| 0570935A1 | 5/1993 | European Pat. Off. . |
| 63-63562 | 3/1988 | Japan . |
| 2184675 | 12/1986 | United Kingdom . |

*Primary Examiner*—Kuang Y. Lin
*Assistant Examiner*—Randy Herrick
*Attorney, Agent, or Firm*—Barnes, Kisselle, Raisch, Choate, Whittemore & Hulbert

[57] ABSTRACT

A vibrating apparatus for vibrating a mold 1 by an electro-hydraulic stepping cylinder 5 through a link mechanism 3 is characterized in that when a driving signal delivered into a drive unit 26 for the stepping cylinder 5, the actual acceleration of the mold 1 is fed back to a target waveform signal for the mold 1 and compensating signals for cancelling the operation delay of the stepping cylinder 5 and the signal transfer lag due to elastic deformation of the link mechanism and the like are added thereto to make feed-forward compensation.

16 Claims, 14 Drawing Sheets

MOLD VIBRATING APPARATUS IN CONTINUOUS CASTING EQUIPMENT

FIELD OF THE INVENTION

The present invention relates to a mold vibrating apparatus for applying a predetermined vibration to the mold during continuous casting operation.

BACKGROUND OF THE INVENTION

Vibrations are applied to the mold in continuous casting equipment by a vibrating apparatus. A known vibrating apparatus of this type is disclosed in Japanese Patent Application Kokai No. 63562/1988.

In this vibrating apparatus, the mold is supported for upward and downward movements in a vertical plane through a four-bar link and a beam, with a hydraulic cylinder connected to the front end of said beam for vibrating the mold. The hydraulic circuit for feeding said hydraulic cylinder with hydraulic pressure is provided with a servo valve and a control circuit for controlling said servo valve.

In this control circuit, the rod position of the hydraulic cylinder and the acceleration of the mold are detected by respective sensors. It is arranged that the individual detected values are fed back to improve the vibration transfer characteristic to allow the vibrations of the mold to take a predetermined vibration waveform.

The reason why the vibration transfer characteristic has to be improved in this manner is as follows.

Attempts have recently been made to generate in the mold a saw-tooth vibration waveform adapted to increase and decrease the upward and downward movements of the mold, respectively, so as to improve the quality of the surfaces of castings produced by continuous casting. Such saw-tooth non-sinusoidal waveform contains harmonic wave components, such as second and third. And under certain vibrating conditions, the mechanical support structure including beams for supporting the entire mold resonates with such harmonic wave components, making it impossible to obtain a predetermined vibration waveform. Therefore, the attempts are intended to prevent the occurrence of such phenomena.

In this connection, it is to be noted that the above arrangement is based on the principle of detecting the Pod position of the hydraulic cylinder and the acceleration of the mold, and feeding back these detected values so as to obtain a predetermined vibration waveform. However, since the subject of control is complicated and the sensor attaching locations are limited, there is a problem that a predetermined vibration waveform is hard to obtain.

Further, in continuous casting equipment, since the environmental conditions are poor, the sensors tend to break down. Therefore, if a sensor breaks down, the hydraulic cylinder runs away and hence the vibration has to be stopped. That is, it is necessary to stop casting, thus offering a problem that waste is involved as the molten metal has to be brought back into the ladle and scrap formation takes place.

SUMMARY OF THE INVENTION

Accordingly, an object of the present invention is to accurately vibrate the mold and to make it possible to continue the control of mold vibration even when a sensor breaks down.

To achieve this object, a first mold vibrating apparatus according to the present invention includes a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, and is characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal from said mechanical compensating signal generator a stepping cylinder compensating waveform signal for remedying the waveform disturbance caused by the operation delay of said electrohydraulic stepping cylinder, and a feedback signal generator for receiving a displaced state signal from a displaced state detector which detects the displaced state of said mold, calculating the difference between said displaced state signal and a target displaced state signal obtained from said target waveform signal generator, and adding the deviation signal obtained by this subtraction to the waveform signal delivered from said mechanical compensating signal generator.

A second mold vibrating apparatus according to the invention includes a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, and is characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal delivered from said mechanical compensating signal generator a stepping cylinder compensating waveform signal for remedying the waveform disturbance caused by the operation delay of said electrohydraulic stepping cylinder, and a feedback signal generator for receiving a displaced state signal from a displaced state detector which detects the displaced state of said mold, calculating the difference between said displaced state signal and a target displaced state signal obtained from said target waveform signal generator, and adding the deviation signal obtained by this subtraction to the target waveform signal delivered from said target waveform signal generator.

A third mold vibrating apparatus according to the invention includes a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, and is characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal From said mechanical compensating signal generator a stepping cylinder compensating waveform signal for remedying the waveform disturbance caused by the operation delay of said electrohydraulic stepping cylinder, and a feedback signal generator for receiving a position signal from a position detector which detects the position of said mold, calculating the difference between said position signal and a target position signal obtained from said target waveform signal generator, and adding the deviation signal obtained by this subtraction to the waveform signal delivered from said mechanical compensating signal generator.

A fourth mold vibrating apparatus according to the invention includes a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, and is characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal delivered from said mechanical compensating signal generator a stepping cylinder compensating waveform signal for remedying the waveform disturbance caused by the operation delay of said electrohydraulic stepping cylinder, and a feedback signal generator for receiving a position signal from a position detector which detects the position of said mold, calculating the difference between said position signal and a target position signal obtained from said target waveform signal generator, and adding the deviation signal obtained by this subtraction to the target waveform signal delivered from said target waveform signal generator.

According to each of the arrangements described above, in imparting a predetermined vibration waveform, i.e., a target waveform to the mold through the support structure by the electrohydraulic stepping cylinder, feed-forward compensation is employed which adds (a) the compensation signal which cancels the motion transfer lag caused by elastic deformation of the support structure and (b) a compensation signal for remedying the operation delay of the electrohydraulic stepping cylinder and feedback control is also employed which corrects the difference between the actual vibration waveform of the mold and the target waveform signal or the waveform signal delivered from the mechanical compensating signal generator; the deviation of the actual vibration waveform of the mold can be corrected on a real time basis. Therefore, highly accurate control which is little affected by disturbance can be effected.

Further, in the feedback control, since the displaced state and/or position of the mold is fed back, noise or other signal processing is facilitated as compared with the case where besides detecting the displaced state of the mold, fed back are the rod position of the hydraulic cylinder which is the driving device for mold vibration, the rod position of the electrohydraulic stepping cylinder and the rotational position of the driving servo motor therefor. Furthermore, even when a sensor breaks down to paralyze the feedback control function, the feed-forward compensation alone is effective to allow the vibration control of the mold to be continued.

Further, fifth through eighth mold vibrating apparatuses according to the invention are the same as said first through fourth mold vibrating apparatuses except that the electrohydraulic stepping motor is replaced by an electrohydraulic servo cylinder.

In this case also, the same functions and merits as those of said first through fourth mold vibrating apparatuses can be obtained.

A ninth mold vibrating apparatus according to the invention includes a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, and is characterized in that:

an electrohydraulic stepping cylinder is used as said cylinder device, said control unit comprises a target waveform signal generator for generating a target waveform signal for the mold, a first hydraulic compensating signal generator for adding to the target waveform signal delivered from said target waveform signal generator a cylinder compensating waveform signal for remedying the waveform disturbance caused by the operation delay of said electrohydraulic stepping cylinder, a mechanical compensating signal generator for adding to the waveform signal from said first hydraulic compensating signal generator a mechanical compensating waveform signal for cancelling a motion transfer lag caused by elastic deformation of said support structure, a filter circuit for receiving the target waveform signal from said target waveform signal generator to deliver a correcting waveform signal for averaging the gain in the frequency characteristic thereof, an adaptive control circuit for controlling the control coefficient in said filter circuit to provide an optimum value according to the deviation signal between said target waveform signal and the displaced state signal, a feedback control section for generating a feedback control signal on the basis of the deviation signal obtained by subtracting the correction waveform signal delivered from said filter circuit from the displaced state signal from said displaced state detector, and a second hydraulic compensating signal generator for adding a hydraulic compensating signal to the feedback control signal from said feedback control section, the arrangement being such that the deviation signal having the output signal from said second hydraulic compensating signal generator added thereto is added to the waveform signal delivered from said mechanical compensating signal generator.

According to the above arrangement, in imparting a predetermined vibration waveform, i.e., a target waveform to the mold through the support structure by the electrohydraulic stepping cylinder, feed-forward control is employed which adds (a) the compensation signal which cancels the operation delay of the electrohydraulic stepping cylinder and (b) a compensation signal for cancelling the motion transfer lag caused by elastic deformation of the support structure and feedback control is also employed which delivers as a deviation signal the difference between the actual vibration waveform of the mold and the correction waveform signal which cancels the resonance due to the intrinsic frequency of the mold vibrating system, the arrangement being such that when said correction waveform signal is calculated by the filter circuit, the control parameters in the filter circuit are optimized on a real time basis. Therefore, the deviation of the actual vibration waveform and resonance can be reliably corrected. Therefore, highly accurate control which is little affected by disturbance can be effected.

In the feedback control, since the signal obtained on the basis of the displaced state of the mold is fed back, the occurrence of control failure or the like due to the breakdown of a sensor is minimized. Further, even if the feedback control function stops owing to the breakdown of a sensor, the feed-forward compensation enables the vibration control of the mold to continue, so that formation of scrap due to stoppage of casting operation can be prevented.

Further, since it is arranged that the control parameters of the filter circuit are corrected on a real time basis, even if the characteristics of the electrohydraulic stepping cylinder change with time or even if the intrinsic frequency of the mold vibrating system slightly changes when the mold is exchanged for one of the same weight and same size, optimum vibration control can always be made.

Further, a tenth mold vibrating apparatus according to the invention is the same as said ninth mold vibrating apparatus except that the electrohydraulic stepping motor is replaced by an electrohydraulic servo cylinder.

In this case also, the same functions and merits as those of said ninth mold vibrating apparatus can be obtained.

Other numerous features and merits of the invention will be made clear from embodiments of the invention to be described with reference to the accompanying drawings.

DESCRIPTION OF THE PREFERRED EMBODIMENTS

A mold vibrating apparatus according to a first embodiment now be described with reference to FIGS. 1 through 4.

FIGS. 1 through 4 correspond to claims 1 through 4, respectively.

Figure 1:
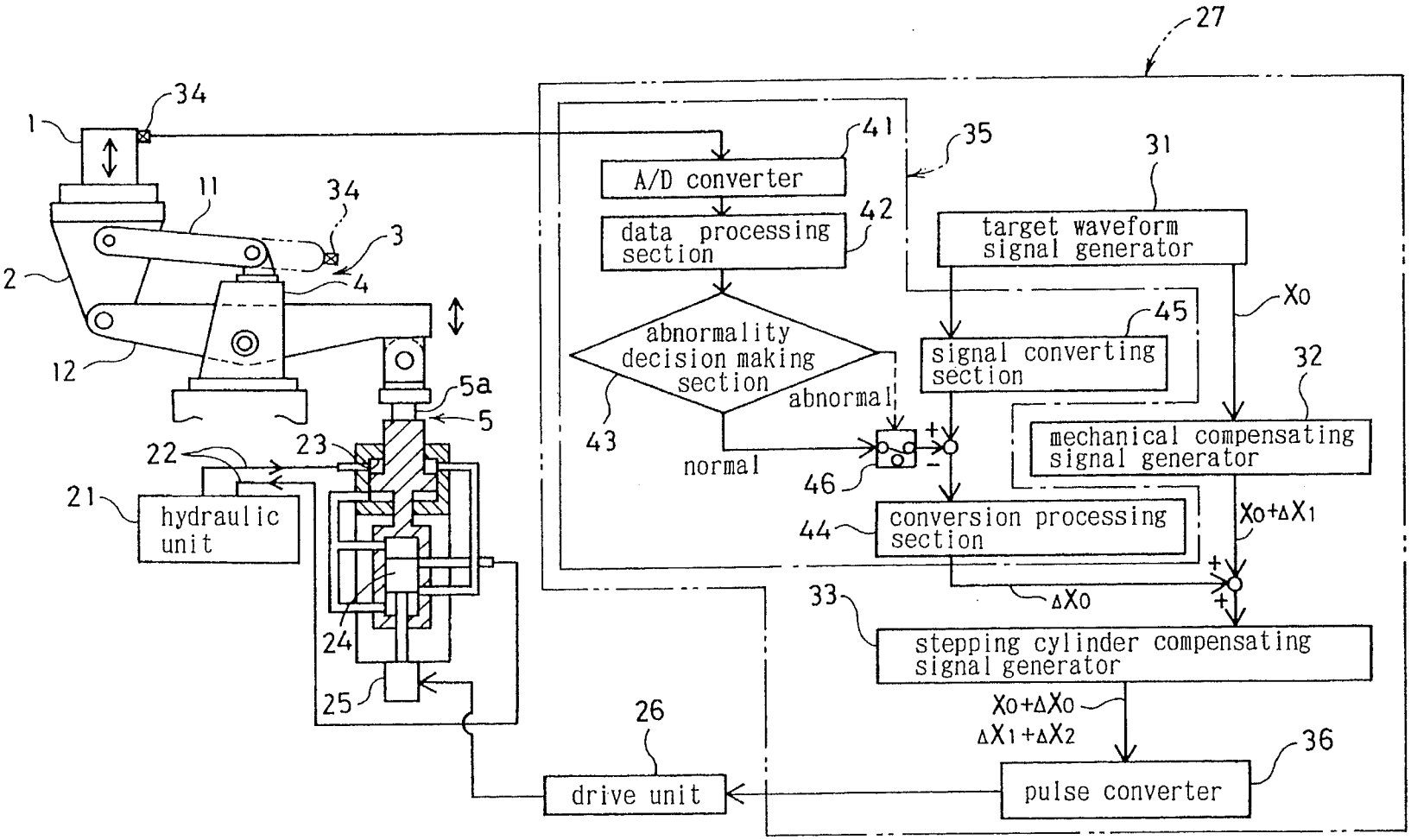
FIG. 1 is a view showing the entire arrangement of a mold vibrating apparatus according to a first embodiment of the invention.

In FIG. 1, the numeral 1 denotes a mold in continuous molding equipment, said mold being placed on a table 2. And, this mold 1 is supported for swing movement in a vertical plane with respect to a support block 4 through the table 2 and a link mechanism 3 and is vertically vibrated by a electrohydraulic stepping cylinder 5 connected to said link mechanism 3.

The link mechanism 3 comprises an upper link 11 and a lower link 12. The upper and lower links 11 and 12 are pin-connected at one of their respective ends to the table 2. Further, the other end of said upper link 11 and the intermediate portion of said lower link 12 are supported by the support block 4 through pins, and the other end of said lower link 12 is pin-connected to the rod 5*a* of said stepping cylinder 5.

Connected to said stepping cylinder 5 through a hydraulic pipes 22 is a hydraulic unit 21 for feeding hydraulic fluid. Further, there are an electric stepping motor (driving section) 25 which moves a spool 24 for feeding successive predetermined amounts of hydraulic fluid from the hydraulic unit 21 to a cylinder chamber 23, and a drive unit 26 for driving said stepping motor 25.

And there is a control unit (for which a high speed digital controller is used) 27 for controlling the drive unit 26 of the stepping motor 25.

This control unit 27 comprises a target waveform signal generator 31 for generating a target waveform signal for vibrating the mold 1, a mechanical compensating signal generator 32 for adding to a target waveform signal delivered from said target waveform signal generator 31 a compensating waveform signal for cancelling a motion transfer lag caused by elastic deformation of the mechanical support structure including the link mechanism 3 and table 2, a stepping cylinder compensating signal generator (hydraulic compensating signal generator) 33 for adding to a waveform signal from said mechanical compensating signal generator 32 a compensating waveform signal for remedying waveform disturbance caused by the operation delay of the stepping cylinder 5, a feedback circuit (feedback signal generator) 35 for receiving an acceleration signal (displaced state signal) from an acceleration sensor (displaced state detector) 34 which is attached to said mold 1 to detect the displaced state, e.g., acceleration, of the mold 1, said received signal being converted into, e.g., a velocity signal, subtracting said velocity signal from a target velocity signal (target displaced state signal) delivered from said target waveform position signal generator 31, converting the deviation signal obtained by this subtraction into a position signal and adding the latter to the waveform signal delivered from said mechanical compensating signal generator 32, a pulse converter 36 for receiving the driving signal obtained by the addition of the individual compensating signals and delivering a pulse signal to said drive unit 26.

Further, the feedback circuit 35 comprises an A/D converter 41 for A/D-converting the acceleration signal from the acceleration sensor 34 attached to the mold 1, a data processing section 42 for applying a predetermined processing (e.g., integration) to the A/D-converted digital acceleration signal, an abnormality decision making section 43 for making decision as to abnormality of the processing signal delivered from the data processing section 42, a signal converting section 44 for applying a predetermined arithmetic operation to the target waveform signal delivered from the target waveform signal generator 31 and converting it into a target signal of the same kind as said processing signal, a conversion processing section 45 for applying a predetermined conversion processing (processing signal/position signal conversion) to the deviation signal obtained by subtracting said processing signal from the target signal delivered from said signal converting section 44 and for adding this converted deviation signal serving as position data to the waveform signal delivered from said mechanical compensating signal generator 32. Further, the output path from said abnormality decision making section 43 is provided with a signal switch 46 which, when the processing signal is judged to be abnormal by the abnormality decision making section 43, cuts off the delivery of said signal. In addition, feed-forward control is effected by said mechanical compensating signal generator 32 and stepping cylinder compensating signal generator 33.

In the above arrangement, let $x_0$ be the target waveform signal delivered from the target waveform signal generator 31 for the mold 1, ($\Delta x_0$) be the deviation signal delivered from the feedback circuit 35, and ($\Delta x_1$) and ($\Delta x_2$) be the compensating signals delivered from the mechanical compensating signal generator 32 and stepping cylinder compensating signal generator 33, respectively, which constitute the feed-forward compensating circuit. Then, the signal (driving signal) x which is fed into the pulse converter 36 is $(x_0+\Delta x_0+\Delta x_1+\Delta x_2)$.

In addition, the deviation signal from the feedback circuit 35 is added to the waveform signal delivered from the mechanical compensating signal generator 32; however, the signals herein are in the state of having been subjected to function processing. Further, conversion into position data is effected at time intervals in the stepping cylinder compensating signal generator 33.

In the feedback circuit 35, the actual acceleration signal for the mold 1 is fed in and converted into a digital signal and subjected to integration in the data processing section 42 to be converted into a velocity signal, the latter is judged as to abnormality in the abnormality decision making section 43. If this velocity signal is judged to be normal, it is delivered as such. On the other hand, in the signal converting section 44, the target waveform signal, which is input position data, is converted (by arithmetic operation) into a target velocity signal, which is then delivered. And the velocity signal passing the abnormality decision making section 43 is subtracted from the conversion-processed target velocity signal. The deviation signal obtained by this subtraction is converted into a deviation signal serving as position data in the conversion processing section 45, which is then added to the waveform signal delivered from the mechanical compensating signal generator 32.

Further, in the feed-forward compensating section, the compensating signal ($\Delta x_1$) for cancelling the signal transfer lag due to elastic deformation of said mechanical support structure and the compensating signal ($\Delta x_2$) for remedying the operation delay of the stepping cylinder 5 are calculated. In addition, the compensating signals ($\Delta x_1$) and ($\Delta x_2$) are compensating components which are theoretically found such that the mold 1 produces the same waveform as the predetermined target vibration waveform, and they can be found as by the reciprocal of the transfer function between the input to the stepping cylinder 5 and the output from the mechanical support structure. Such compensating components can also be provided by a function such as Fourier series. Further, as described above, the compensating signal ($\Delta x_2$) obtained in the stepping cylinder compensating signal generator 33 is given a time value and delivered as position data.

The control in the above arrangement will now be described in concrete.

As for the mechanical support structure, it is not a perfectly rigid body; thus, if the output waveform component of the rod **5*a* of the stepping cylinder 5 contains higher components, such components cause the mechanical support structure, e.g., the link mechanism 3**, to develop a resonance phenomenon.

Particularly in the case where the signal waveform is a non-sinusoidal waveform, such as saw-tooth waveform, the target waveform signal itself contains a lot of higher components, tending to cause resonance.

Therefore, it is arranged that a waveform signal which contains a signal component which cancels the resonance of the mechanical support structure composed of the link mechanism 3 and table 2 is delivered from the stepping cylinder 5.

In the stepping cylinder 5, the hydraulic operation delay is compensated. That is, the movement of the rod **5*a* is controlled by controlling the movement of the valve and spool 24; however, for the rod 5*a* to move at a predetermined speed, it is necessary that the degree of opening of the valve be above a certain value. Thus, an operation delay (phase lag) takes place between input and output. The input waveform is compensated in such a manner as to cancel this operation delay to ensure that the output waveform of the stepping cylinder 5** has the same phase and waveform as the predetermined waveform.

That is, said compensating signal ($\Delta x_1$) contains a signal component for cancelling the resonance produced in the mechanical support structure, such as the link mechanism 3 and table 2. Further, said compensating signal ($\Delta x_2$) contains a signal component for remedying the operation delay caused by the stepping cylinder 5.

In addition, if the abnormality decision making section 43 decides that the velocity signal is abnormal, that is when the acceleration sensor 34 breaks down, the signal switch 46 cuts off the delivery of the velocity signal. That is, the situation is avoided in which the feedback control stops functioning with the result that the entire system runs uncontrollable. Of course, in this case, the feed-forward compensation alone functions.

In this manner, since feed-forward compensation is employed together with feedback control for correcting the amount of deviation from the target waveform signal in real time on the basis of acceleration actually acting on the mold 1, it is possible to dispense with the position detection sensor for detecting the position of the rod of a hydraulic cylinder as previously described with reference to the prior art example, and it is also possible to correct in real time the difference between the actual vibration waveform of the mold 1 and the target waveform, which could not be corrected by the feed-forward control alone. Therefore, highly accurate control which is little affected by disturbance can be effected.

Further, since the position sensor for detecting the rod position of the stepping cylinder can be dispensed with, it is no longer necessary to worry about a runaway of the stepping cylinder which could occur if the position sensor were broken down.

In this first embodiment, it has been stated that in detecting the position of the mold 1, the acceleration sensor 34 is used and the acceleration signal is converted into a velocity signal, so as to provide a deviation signal; however, the acceleration signal as such may be used as the deviation signal. In this case, in the signal converting section 43, the target waveform signal is converted into acceleration data and subtraction is made between acceleration signals, and in the conversion processing section 44, after the result is converted into a waveform signal, the latter is added to a waveform signal delivered as a deviation signal from the mechanical compensating signal generator 32.

In this first embodiment, it has been stated that the acceleration sensor (displaced state detector) 34 is attached to the mold 1; however, it may be attached to the table 2 or, as shown in phantom lines in FIG. 1, it may be attached to the end of the upper link 11.

Figure 2:
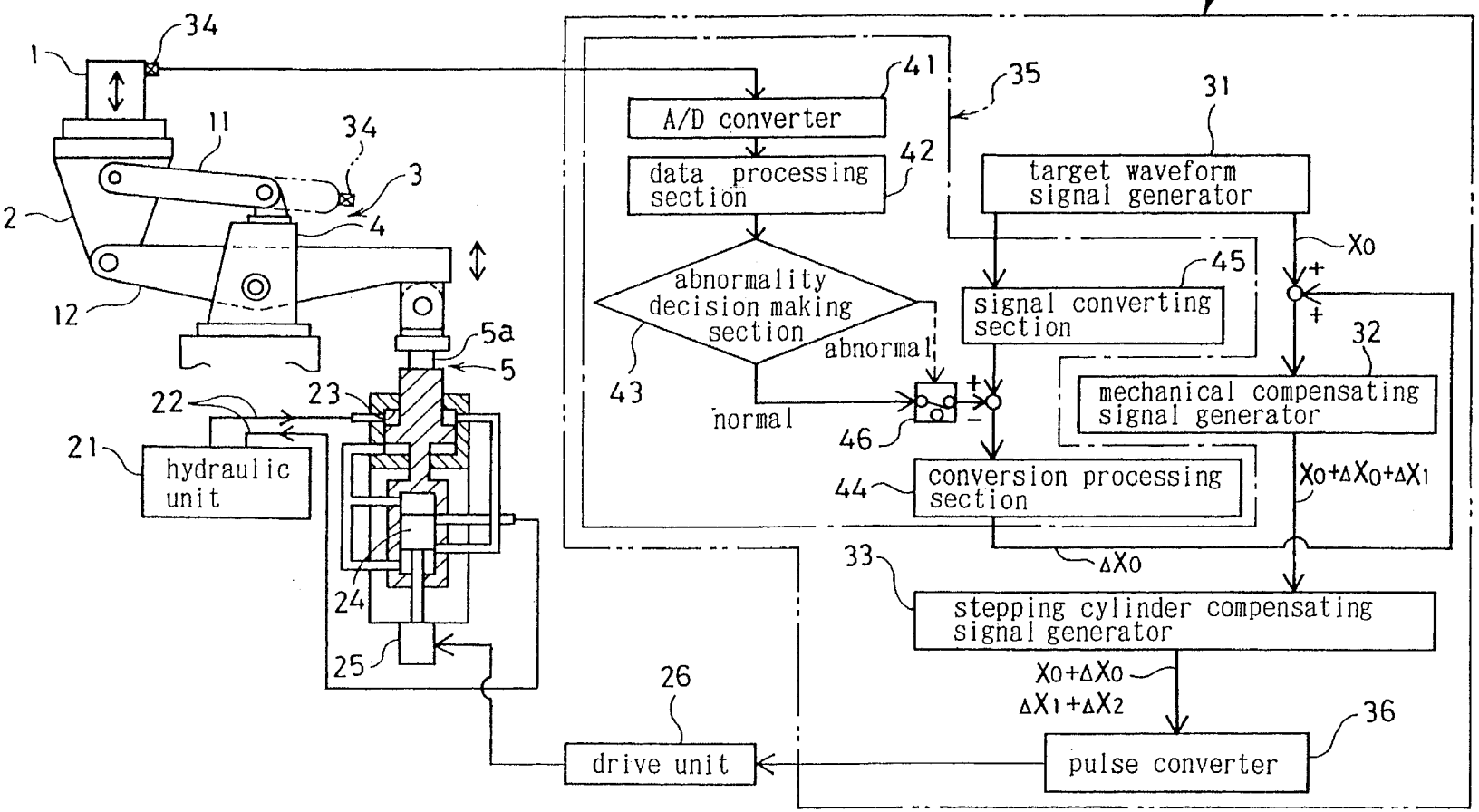
FIG. 2 is a view showing the entire arrangement of a modification of the mold vibrating apparatus according to the first embodiment of the invention.

In this connection, in the first embodiment, it has been stated that the deviation signal ($\Delta x_0$) obtained from the feedback circuit 35 is added to the waveform signal delivered from the mechanical compensating signal generator 32; however, as shown in FIG. 2, this deviation signal ($\Delta x_0$) may be added to the target waveform signal (the signal before being fed into the mechanical compensating signal generator 32) delivered from the target waveform signal generator 31. In this case also, the same merits as those in the first embodiment described above can be obtained.

Figure 3:
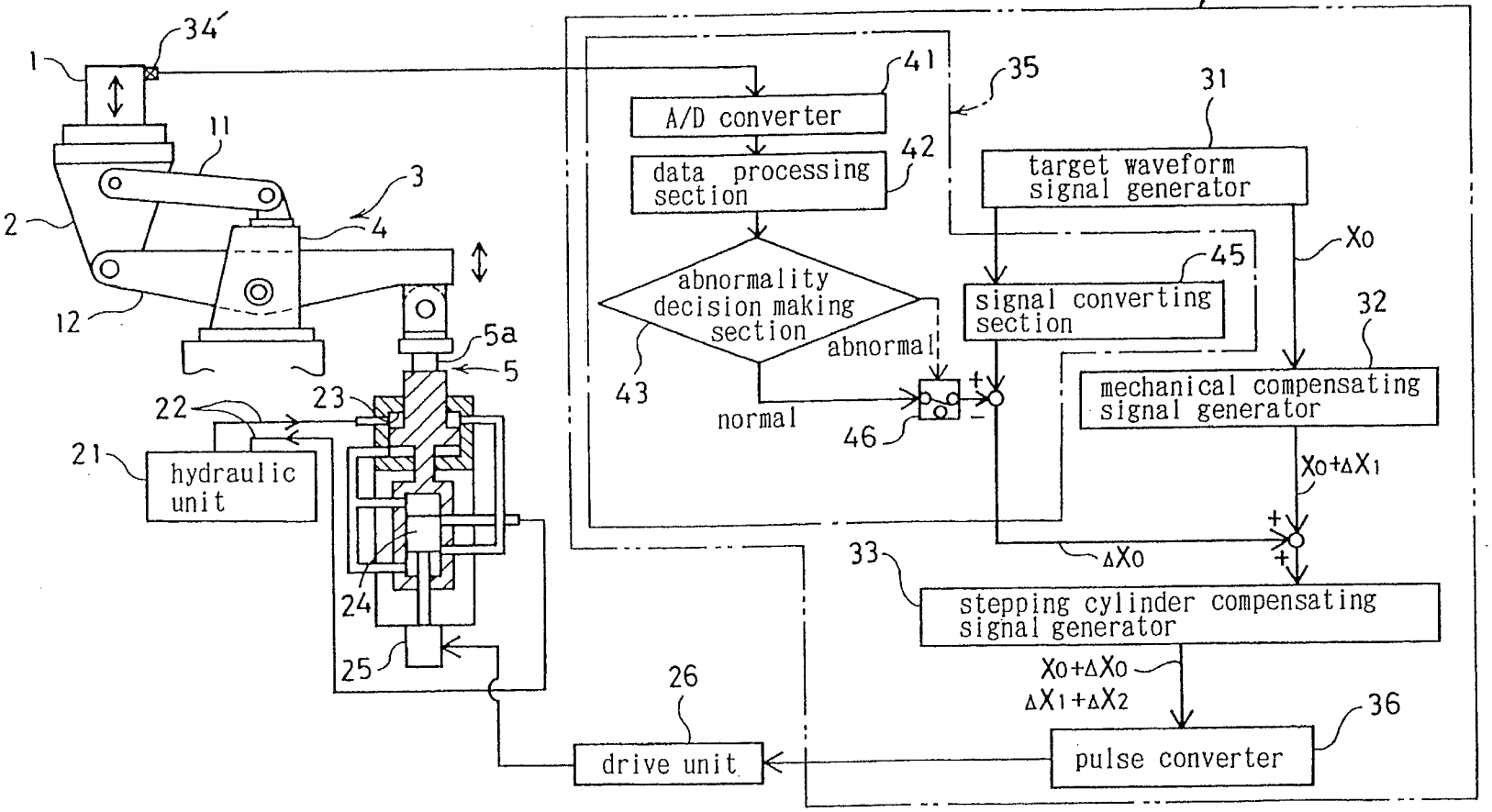
FIG. 3 is a view showing the entire arrangement of a modification of the mold vibrating apparatus according to the first embodiment of the invention.
Figure 4:
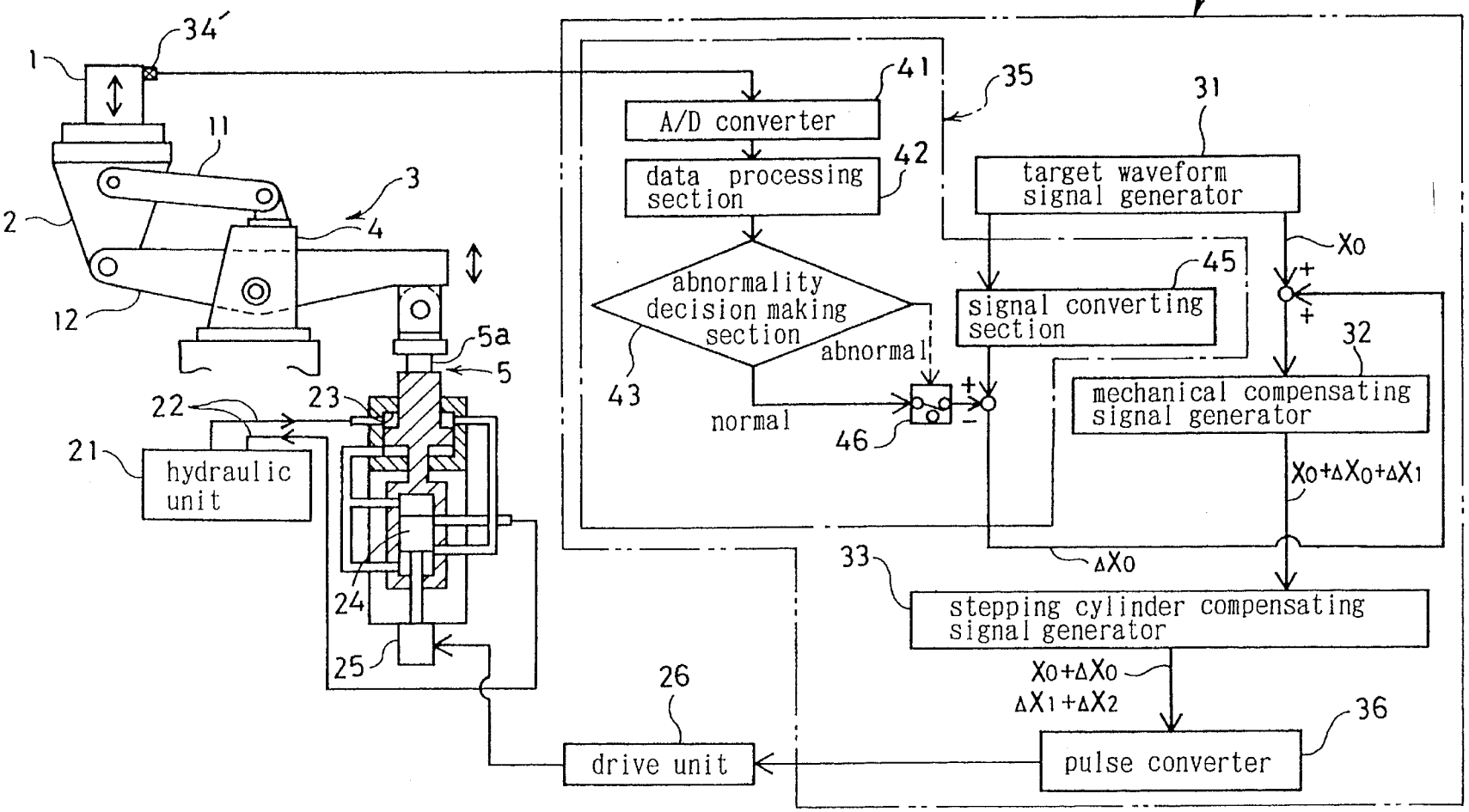
FIG. 4 is a view showing the entire arrangement of a modification of the mold vibrating apparatus according to the first embodiment of the invention.

Further, in this first embodiment, an acceleration sensor has been installed for detecting the position of the mold 1; however, as shown in FIG. 3, a position detecting sensor (position detector) 34' for directly detecting the position of the mold 1 may be provided to make feedback control by using the position signal obtained from said position detecting sensor. In this case, subtraction is made between the position signal passing the abnormality decision making section 43 and the target waveform signal delivered from the target waveform signal generator 31 via the signal converting section 43 and the deviation signal obtained by this subtraction is added to the target waveform signal delivered from said target waveform signal generator 31 (or it may be added to the waveform signal delivered from the mechanical compensating signal generator 32, as shown in FIG. 4). Therefore, the conversion processing section .44 becomes unnecessary. However, though not shown, the gain section for multiplying the deviation signal by a predetermined gain will be suitably provided.

In addition, instead of using said position detecting sensor, the acceleration sensor 34 may be used and the acceleration signal may be integrated twice in the data processing section 42 for conversion into position data, which may be used to obtain a deviation signal.

Further, it has been stated that in the feedback circuit 35, the acceleration signal, velocity signal and position signal are separately used as signals to be fed back; however, suitable combinations of these signals may be used. For example, a combination of all signals (acceleration signal+velocity signal+position signal) may be used.

Further, in this first embodiment, it has been stated that vibrations are imparted to the mold through the table and link mechanism; however, a stepping cylinder may be directly connected to the table supporting the mold. In addition, in this case, the table will be considered as a mechanical support structure for signal transfer.

A mold vibrating apparatus according to a second embodiment of the invention will now be described with reference to FIGS. 5 through 8.

FIGS. 5 through 8 correspond to claims 5 through 8, respectively.

The point which differs from the first embodiment is that the cylinder device for imparting vibrations to the mold is an electrohydraulic stepping cylinder in the first embodiment but in the second embodiment it is an electrohydraulic servo cylinder.

Figure 5:
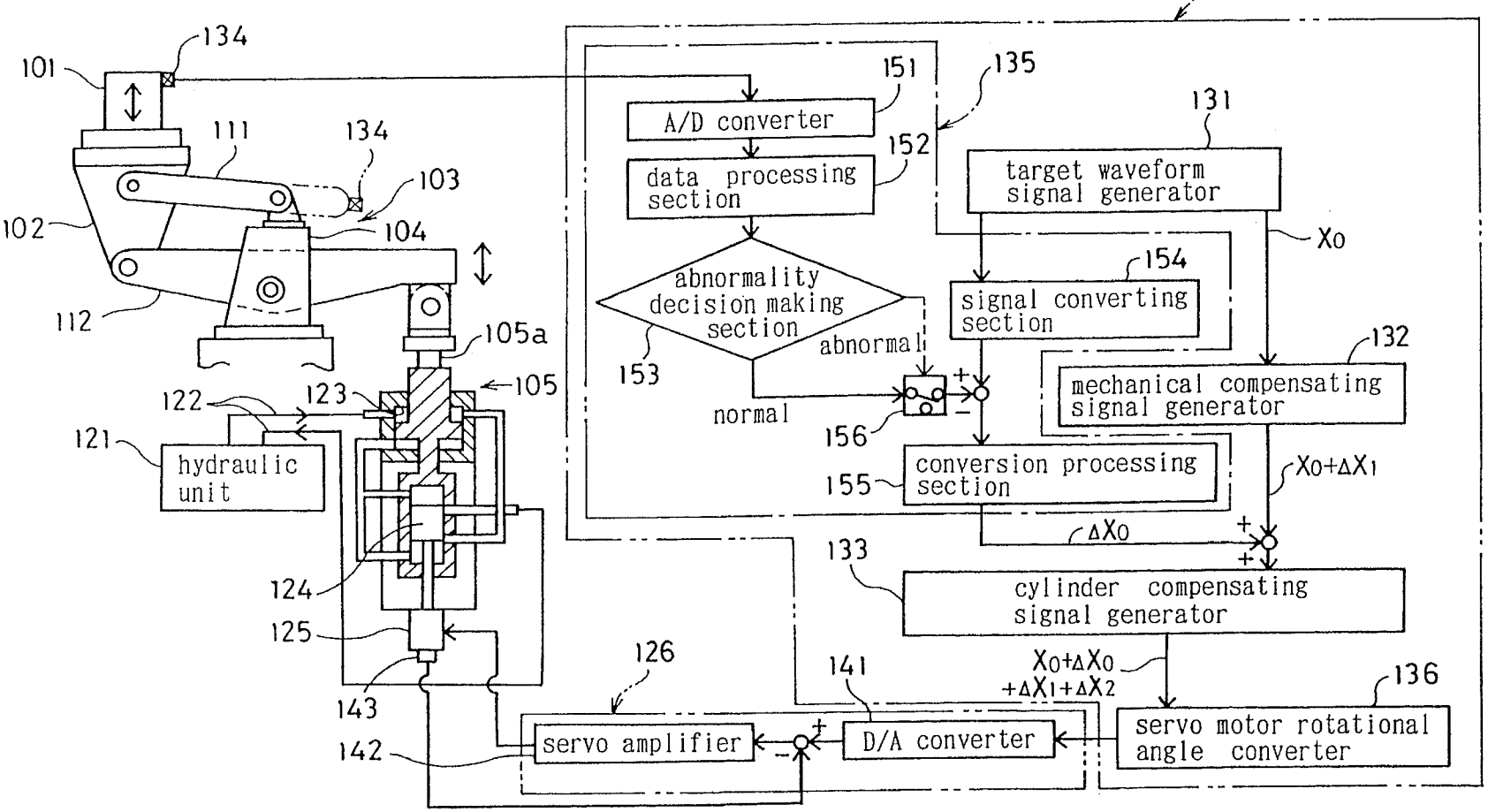
FIG. 5 is a view showing the entire arrangement of a mold vibrating apparatus according to a second embodiment of the invention.

In FIG. 5, the numeral 101 denotes a mold in continuous molding equipment, said mold being placed on a table 102. And, this mold 101 is supported for swing movement in a vertical plane with respect to a support block 104 through the table 102 and a link mechanism 103 and is vertically vibrated by a electrohydraulic servo cylinder 105 connected to said link mechanism 103.

The link mechanism 103 comprises an upper link 111 and a lower link 112. The upper and lower links 111 and 112 are pin-connected at one of their respective ends to the table 102. Further, the other end of said upper link 111 and the intermediate portion of said lower link 112 are supported by the support block 104 through pins, and the other end of said lower link 112 is pin-connected to the rod **105*a* of said servo cylinder 105**.

Connected to said servo cylinder 105 through a hydraulic pipes 122 is a hydraulic unit 121 for feeding hydraulic fluid. Further, there are an electric servo motor (driving section) 125 which moves a spool 124 for feeding successive predetermined amounts of hydraulic fluid from the hydraulic unit 121 to a cylinder chamber 123, and a drive unit 126 for driving said servo motor 125.

And there is a control unit (for which a high speed digital controller is used) 127 for controlling the drive unit 126 of the servo motor 125.

This control unit 127 comprises a target waveform signal generator 131 for generating a target waveform signal for vibrating the mold 101, a mechanical compensating signal generator 132 for adding to a target waveform signal delivered from said target waveform signal generator 131 a compensating waveform signal for cancelling a motion transfer lag caused by elastic deformation of the mechanical support structure including the link mechanism 103 and table 102, a cylinder compensating signal generator (hydraulic compensating signal generator) 133 for adding to a waveform signal from said mechanical compensating signal generator 132 a compensating waveform signal for remedying waveform disturbance caused by the operation delay of the servo cylinder 105, a feedback circuit (feedback signal generator) 135 for receiving an acceleration signal (displaced state signal) from an acceleration sensor (displaced state detector) 134 which is attached to said mold 101 to detect the displaced state, e.g., acceleration, of the mold 101, said received signal being converted into, e.g., a velocity signal, subtracting said velocity signal from a target velocity signal (target displaced state signal) delivered from said target waveform position signal generator 131, converting the deviation signal obtained by this subtraction into a position signal and adding the latter to the waveform signal delivered from said mechanical compensating signal generator 132, a servo motor rotational angle converter 136 for receiving the driving signal obtained by the addition of the individual compensating signals and delivering a rotational angle signal to said drive unit 126.

Said drive unit 126 comprises a D/A converter 141 for converting into a digital signal the rotational angle signal delivered from the servo motor rotational angle converter 136, and a servo amplifier 142 for amplifying the output signal from said D/A converter 141, the arrangement being such that the actual rotational angle of the servo motor 125 is detected by the angle detector 143 installed on the servo motor 125 and the thus-detected rotational angle signal is fed back to the control signal to be fed into the servo amplifier 142.

Further, the feedback circuit 135 comprises an A/D converter 151 for A/D-converting the acceleration signal from the acceleration sensor 134 attached to the mold 101, a data processing section 152 for applying a predetermined processing (e.g., integration) to the A/D-converted digital acceleration signal, an abnormality decision making section 153 for making decision as to abnormality of the processing signal delivered from the data processing section 152, a signal converting section 154 for applying a predetermined arithmetic operation to the target waveform signal delivered from the target waveform signal generator 131 and converting it into a target signal of the same kind as said processing signal, and a conversion processing section 155 for applying a predetermined conversion processing (processing signal/position signal conversion) to the deviation signal obtained by subtracting said processing signal from the target signal delivered from said signal converting section 154 and for adding this converted deviation signal serving as position data to the waveform signal delivered from said mechanical compensating signal generator 132. Further, the output path from said abnormality decision making section 153 is provided with a signal switch 156 which, when the processing signal is judged to be abnormal by the abnormality decision making section 153, cuts off the delivery of said signal. In addition, feed-forward control is effected by said mechanical compensating signal generator 132 and cylinder compensating signal generator 133.

In the above arrangement, let $x_0$ be the target waveform signal delivered from the target waveform signal generator 131 for the mold 101, ($\Delta x_0$) be the deviation signal delivered from the feedback circuit 135, and ($\Delta x_1$) and ($\Delta x_2$) be the compensating signals delivered from the mechanical compensating signal generator 132 and cylinder compensating signal generator 133, respectively, which constitute the feed-forward compensating circuit. Then, the signal (driving signal) x which is fed into the servo motor rotational angle converter 136 is $(x_0+\Delta x_0+\Delta x_1+\Delta x_2)$.

In addition, the deviation signal from the feedback circuit 135 is added to the waveform signal delivered from the mechanical compensating signal generator 132; however, the signals herein are in the state of having been subjected to function processing. Further, conversion into position data is effected at time intervals in the cylinder compensating signal generator 133.

In the feedback circuit 135, the actual acceleration signal for the mold 101 is fed in and converted into a digital signal and subjected to integration in the data processing section 152 to provide a velocity signal, the latter is judged as to abnormality in the abnormality decision making section 153. If this velocity signal is judged to be normal, it is delivered as such. On the other hand, in the signal converting section 154, the target waveform signal, which is input position data, is converted (by arithmetic operation) into a target velocity signal, which is then delivered. And the velocity signal passing the abnormality decision making section 153 is subtracted from the conversion-processed target velocity signal. The deviation signal obtained by this subtraction is converted into a deviation signal serving as a position signal in the conversion processing section 155, which is then added to the waveform signal delivered from the mechanical compensating signal generator 132.

Further, in the feed-forward compensating section, the compensating signal ($\Delta x_1$) for cancelling the signal transfer lag due to elastic deformation of said mechanical support structure and the compensating signal ($\Delta x_2$) for remedying the operation delay of the servo cylinder 105 are calculated. In addition, the compensating signals ($\Delta x_1$) and ($\Delta x_2$) are compensating components which are theoretically found such that the mold 101 produces the same waveform as the predetermined target vibration waveform, and they can be found as by the reciprocal of the transfer function between the input to the servo cylinder and the output from the mechanical support structure. Such compensating components can also be provided by a function such as Fourier series. Further, as described above, the compensating signal ($\Delta x_2$) obtained in the cylinder compensating signal generator 133 is given a time value and delivered as position data.

The control in the above arrangement will now be described in concrete.

As for the mechanical support structure, it is not a perfect rigid body; thus, if the output waveform of the rod **5*a* of the servo cylinder 105 contains higher components, such components cause the mechanical support structure, e.g., the link mechanism 103**, to develop a resonance phenomenon.

Particularly in the case where the signal waveform is a non-sinusoidal waveform, such as saw-tooth waveform, the target waveform signal itself contains a lot of higher components tending to cause resonance.

Therefore, it is arranged that a waveform signal which contains a signal component which cancels the resonance of the mechanical support structure composed of the link mechanism 103 and table 102 is delivered from the servo cylinder 105.

In the servo cylinder 105, the hydraulic operation delay is compensated. That is, the movement of the rod **105*a* is controlled by controlling the movement of the valve and spool 124; however, for the rod 105*a* to move at a predetermined speed, it is necessary that the degree of opening of the valve be above a certain value. Thus, an operation delay (phase lag) takes place between input and output. The input waveform is compensated in such a manner as to cancel this operation delay to ensure that the output waveform of the servo cylinder 105** has the same phase and waveform as the predetermined waveform.

That is, said compensating signal ($\Delta x_1$) contains a signal component for cancelling the resonance produced in the mechanical support structure, such as the link mechanism 103 and table 102. Further, said compensating signal ($\Delta x_2$) contains a signal component for remedying the operation delay caused by the servo cylinder 105.

In addition, if the abnormality decision making section 153 decides that the velocity signal is abnormal, that is when the acceleration sensor 134 breaks down, the signal switch 156 cuts off the delivery of the velocity signal. That is, the situation is avoided in which the feedback control stops functioning with the result that the entire system runs uncontrollable. Of course, in this case, the feed-forward compensation alone functions.

In this manner, since feed-forward compensation is employed together with feedback control for correcting the amount of deviation from the target waveform signal in real time on the basis of acceleration actually acting on the mold 101, it is possible to dispense with the position detection sensor for detecting the position of the rod of a hydraulic cylinder as previously described with reference to the prior art example, and it is also possible to correct in real time the difference between the actual vibration waveform of the mold 101 and the target waveform, which could not be corrected by the feed-forward control alone. Therefore, highly accurate control which is little affected by disturbance can be effected.

Further, since the position sensor for detecting the position of the rod of the servo cylinder can be dispensed with, it is no longer necessary to worry about a runaway of the servo cylinder which could occur if the position sensor were broken down.

In this second embodiment, it has been stated that in detecting the position of the mold 101, the acceleration sensor 134 is used and the acceleration signal is converted into a velocity signal, so as to provide a deviation signal; however, the acceleration signal as such may be used as the deviation signal. In this case, in the signal converting section 153, the target waveform signal is converted into acceleration data and subtraction is made between acceleration signals, and in the conversion processing section 154, after the result is converted into a waveform signal, the latter is added to a waveform signal delivered as a deviation signal from the mechanical compensating signal generator 132.

In this second embodiment, it has been stated that the acceleration sensor (displaced state detector) 134 is attached to the mold 101; however, it may be attached to the table 102 or, as shown in phantom lines in FIG. 5, it may be attached to the end of the upper link 111.

Figure 6:
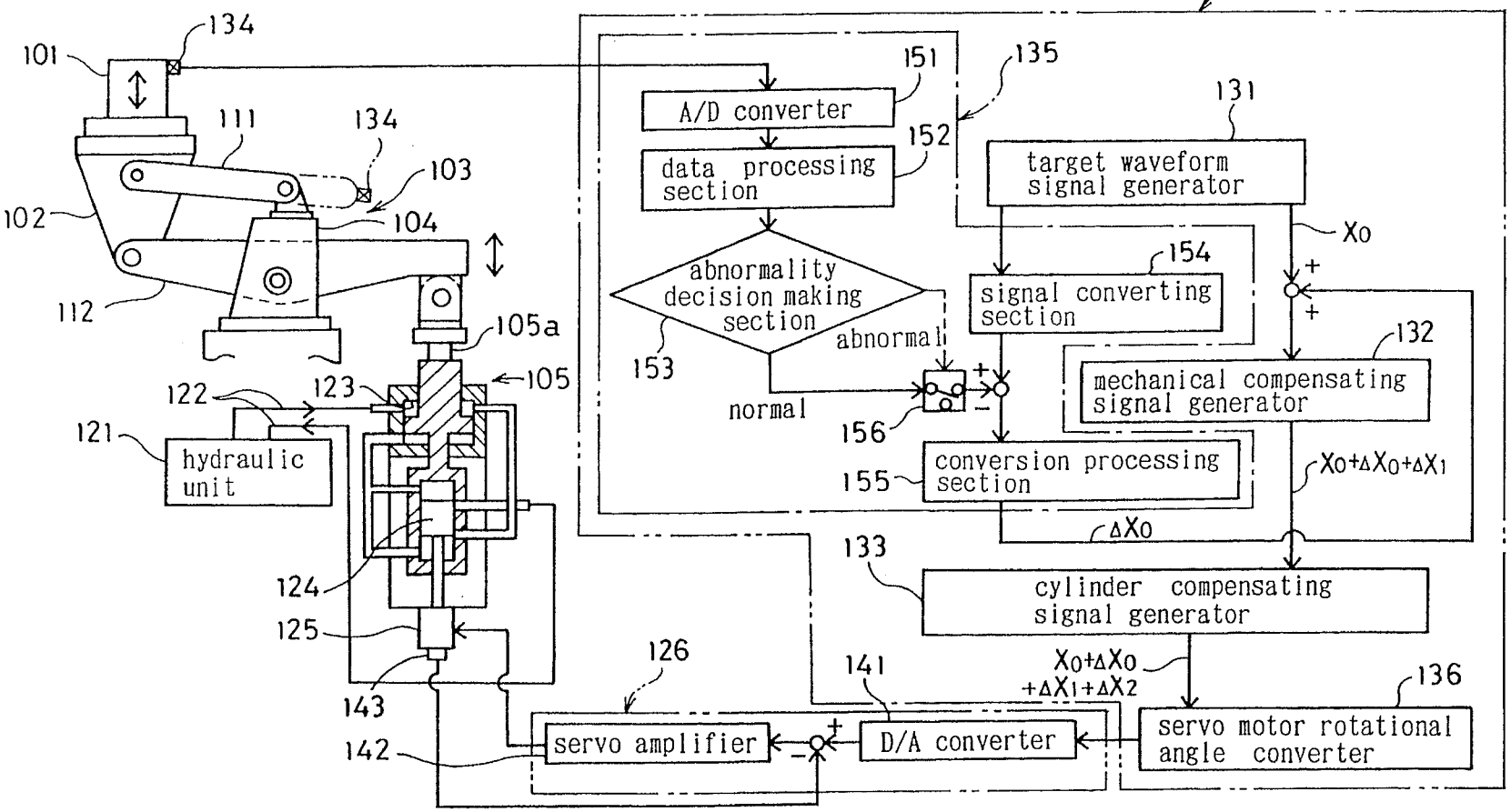
FIG. 6 is a view showing the entire arrangement of a modification of the mold vibrating apparatus according to the second embodiment of the invention.

In this connection, in the second embodiment, it has been stated that the deviation signal ($\Delta x_0$) obtained from the feedback circuit 135 is added to the waveform signal delivered from the mechanical compensating signal generator 132; however, as shown in FIG. 6, this deviation signal ($\Delta x_0$) may be added to the target waveform signal (the signal before being fed into the mechanical compensating signal generator 132) delivered from the target waveform signal generator 131. In this case also, the same merits as those in the second embodiment described above can be obtained.

Figure 7:
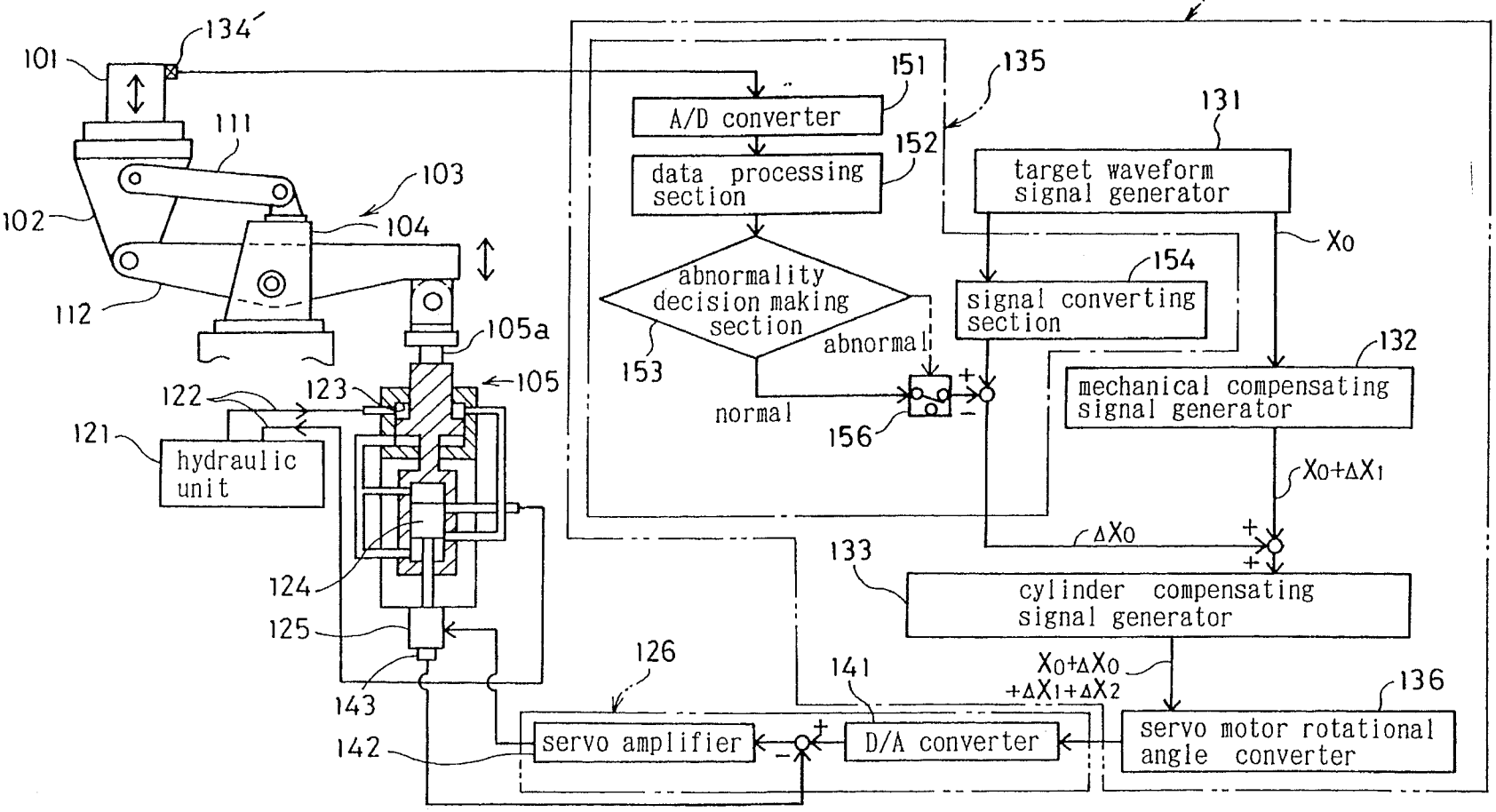
FIG. 7 is a view showing the entire arrangement of a modification of the mold vibrating apparatus according to the second embodiment of the invention.
Figure 8:
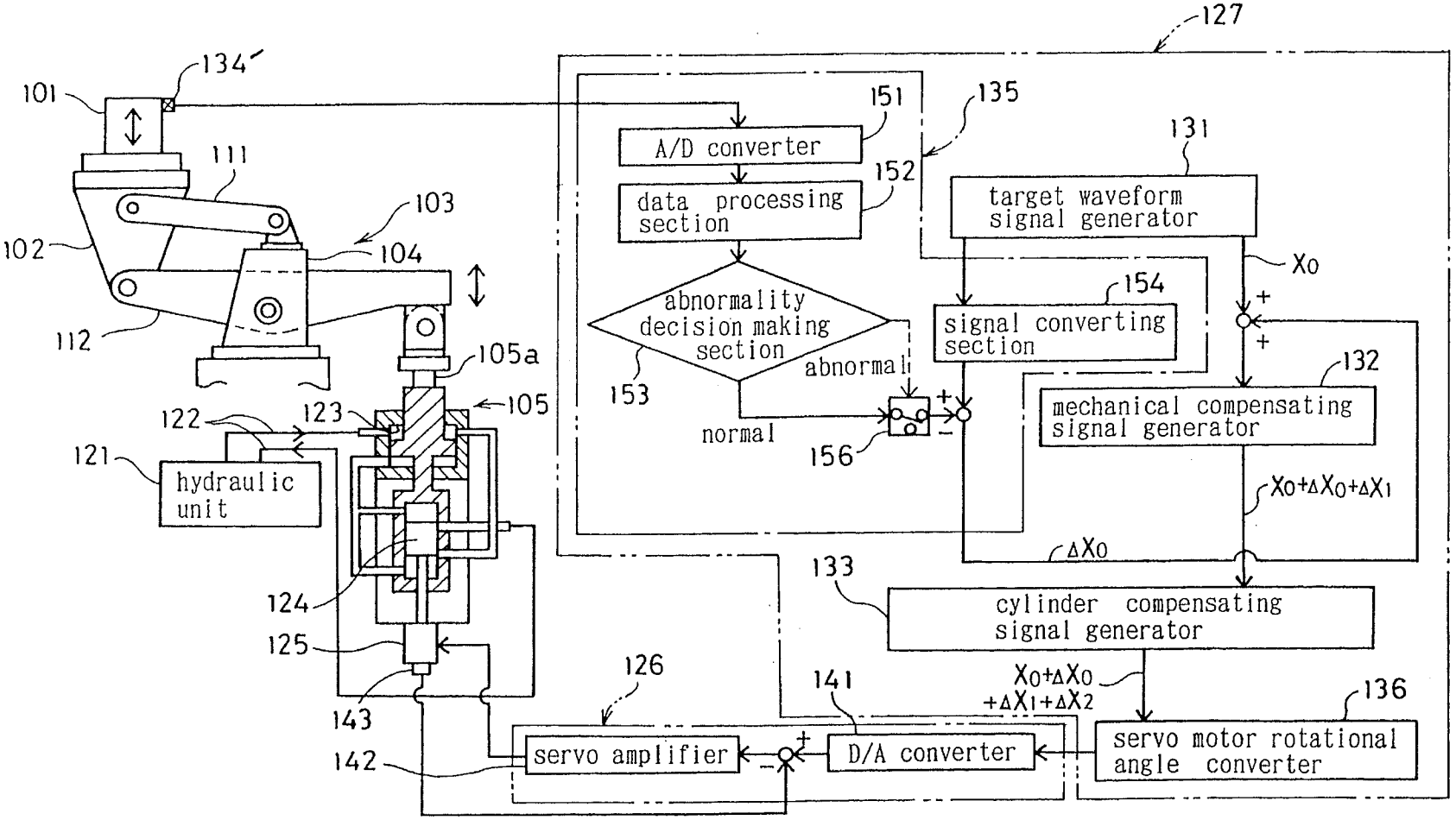
FIG. 8 is a view showing the entire arrangement of a modification of the mold vibrating apparatus according to the second embodiment of the invention.

Further, in this second embodiment, an acceleration sensor has been installed for detecting the position of the mold 101; however, as shown in FIG. 7, a position detecting sensor (position detector) 134' for directly detecting the position of the mold 101 may be provided to make feedback control by using the position signal obtained from said position detecting sensor. In this case, subtraction is made between the position signal passing the abnormality decision making section 153 and the target waveform signal delivered from the target waveform signal generator 131 via the signal converting section 153 and the deviation signal obtained by this subtraction is added to the target waveform signal delivered from said target waveform signal generator 131 (or it may be added to the waveform signal delivered from the mechanical compensating signal generator 132, as shown in FIG. 8). Therefore, the conversion processing section 154 becomes unnecessary. However, though not shown, the gain section for multiplying the deviation signal by a predetermined gain will be suitably provided.

In addition, instead of using said position detecting sensor, the acceleration sensor 134 may be used and the acceleration signal may be integrated twice in the data processing section 152 for conversion into position data, which may be used to obtain a deviation signal.

Further, it has been stated that in the feedback circuit 135, the acceleration signal, velocity signal and position signal are separately used as signals to be fed back; however, suitable combinations of these signals may be used. For example, a combination of all signals (acceleration signal+velocity signal+position signal) may be used.

Further, in this second embodiment, it has been state that vibrations are imparted to the mold through the table and link mechanism; however, a servo cylinder may be directly connected to the table supporting the mold. In addition, in this case, the table will be considered as a mechanical support structure for signal transfer.

A mold vibrating apparatus according to a third embodiment of the invention will now be described with reference to FIGS. 9 through 11.

Figure 9:
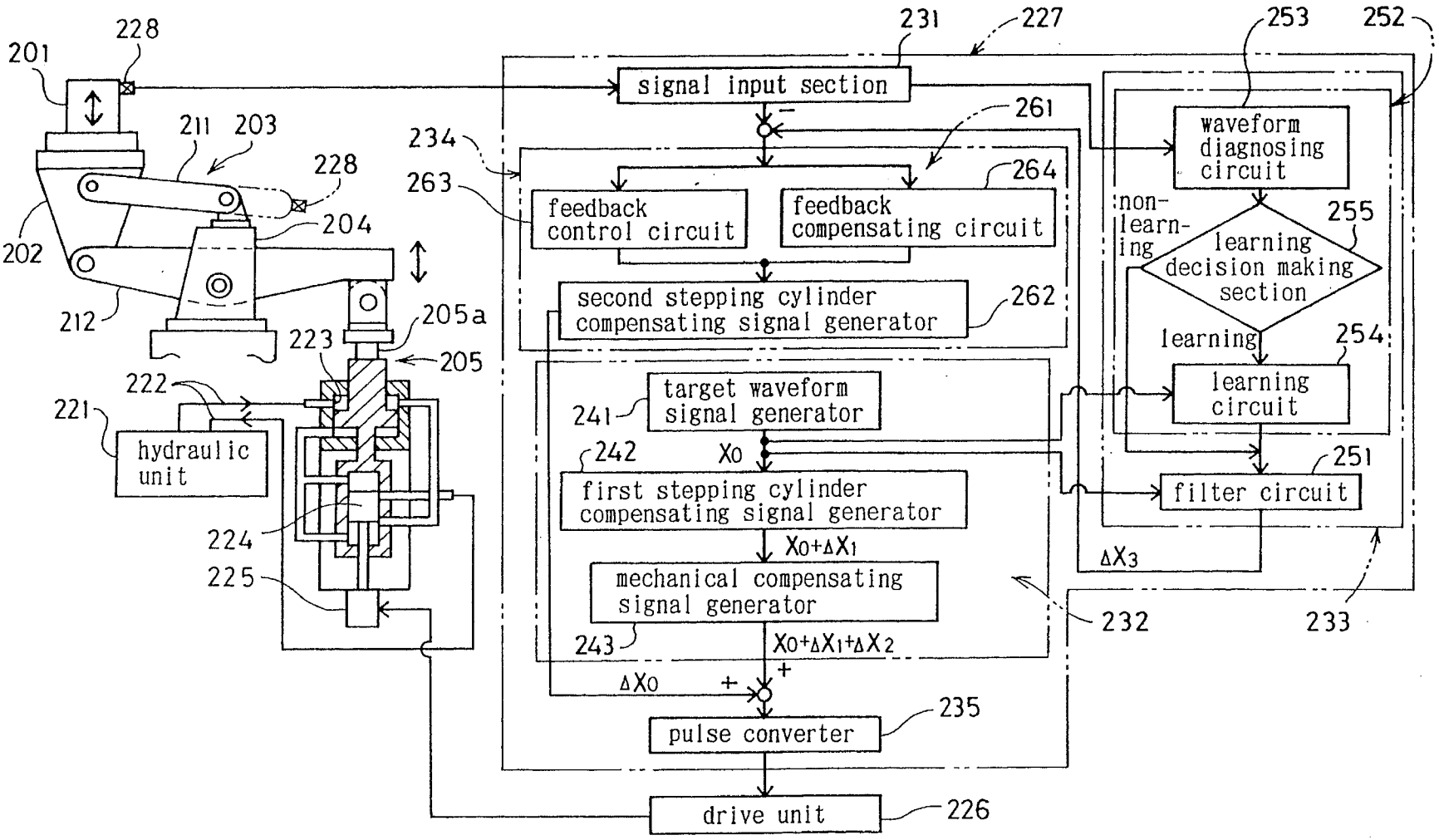
FIG. 9 is a view showing the entire arrangement of a mold vibrating apparatus according to a third embodiment of the invention.
Figure 11:
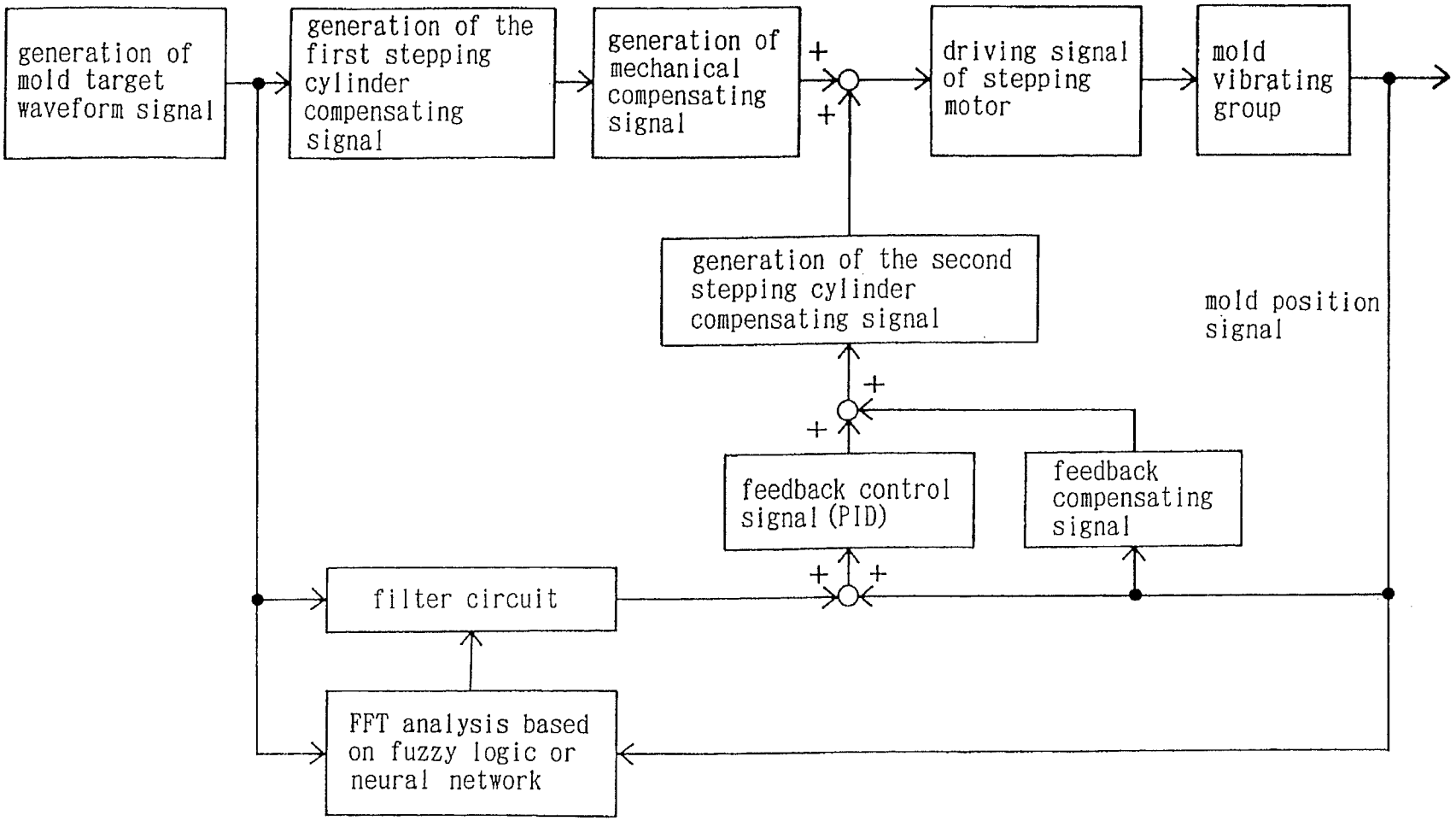
FIG. 11 is a block diagram showing the operation of the principal portion of a modification of the mold vibrating apparatus according to the third embodiment.

FIGS. 9 and 11 correspond to claims 9 and 10 and FIG. 11 corresponds to claims 11 and 12.

Figure 10:
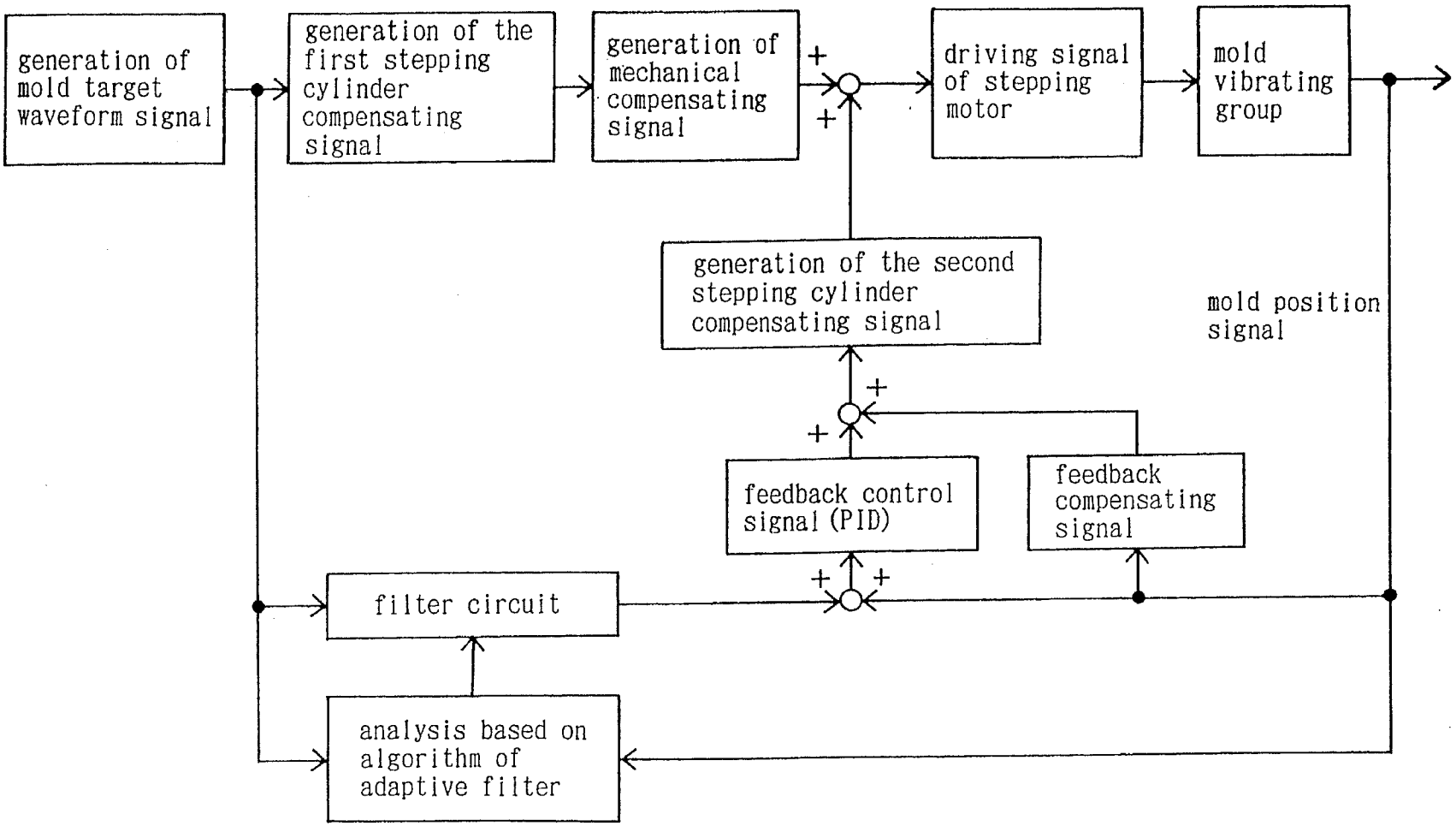
FIG. 10 is a block diagram showing the operation of the principal portion of the mold vibrating apparatus according to the third embodiment.

In FIG. 9 and 10, the numeral 201 denotes a mold in continuous molding equipment, said mold being placed on a table 202. And, this mold 201 is supported for swing movement in a vertical plane with respect to a support block 204 through the table 202 and a link mechanism 203 and is vertically vibrated by a electrohydraulic stepping cylinder 205 connected to said link mechanism 203.

The link mechanism 203 comprises an upper link 211 and a lower link 212. The upper and lower links 211 and 212 are pin-connected at one of their respective ends to the table 202. Further, the other end of said upper link 211 and the intermediate portion of said lower link 212 are supported by the support block 204 through pins, and the other end of said lower link 212 is pin-connected to the rod 205*a* of said stepping cylinder 205.

Connected to said stepping cylinder 205 through a hydraulic pipes 222 is a hydraulic unit 221 for feeding hydraulic fluid. Further, there are an electric stepping motor (driving section) 225 which moves a spool 224 for feeding successive predetermined amounts of hydraulic fluid from the hydraulic unit 221 to a cylinder chamber 223, and a drive unit 226 for driving said stepping motor 225.

And there is a control unit 227 for controlling the drive unit 226 of the stepping motor 225.

This control unit 227 comprises a signal input section 231 having an A/D converter attached to the mold 201 and receiving an actual mold position signal (which is an example of displaced state signal, thereinafter referred to simply as the actual position signal) from a position sensor (displaced state detector) 228 for detecting the displaced state, e.g., vibrating position of the mold 201, said converter converting said actual position signal into a digital signal, a first control section 232 for generating a target waveform signal for the mold, a second control section 233 for delivering a correcting waveform signal for smoothing the gain in the frequency characteristic thereof to the position signal from the signal input section 231, a third control section 234 for obtaining a deviation signal by subtracting the correcting waveform signal from the second control section 233 from the actual position signal for the mold, calculating a predetermined feedback control signal on the basis of said deviation signal, and adding this feedback signal to the output signal from the first control section 232, and a pulse converter 235 for receiving a drive signal obtained by adding the output signals from the two control sections 232 and 234 so as to deliver a pulse signal to the drive unit 226.

The first control section 232 comprises a target waveform signal generator 241 for generating a target waveform signal for vibrating the mold 201, a first stepping cylinder compensating signal generator (first hydraulic compensating signal generator) 242 for adding to the target waveform signal delivered from said target waveform signal generator 241 a compensating waveform signal for remedying the waveform disturbance caused by the operation delay (e.g., lag due to switching of valves, and compression of oil) of the stepping cylinder 205, and a mechanical compensating signal generator (for example, correction of acceleration of the mold is made) 243 for adding a compensating waveform signal for cancelling the motion transfer lag due to elastic deformation of the mechanical support structure including the link mechanism 203 and table 202.

The second control section 233 is provided with a filter circuit 251 for receiving the target waveform signal from the target waveform signal generator 241 to deliver a correcting waveform signal (in concrete, a waveform signal for cancelling the intrinsic frequency of the mold vibrating system) for smoothing the gain in the frequency characteristic thereof in accordance with said target waveform signal, an adaptive control circuit 252 for opitimizing the characteristics in said filter circuit 251, i.e., the control parameters in real time in accordance with the actual vibrating state of the mold 201. As for said filter circuit 251, use is made, e.g., of a target value filter or a notch filter.

The adaptive control circuit 252 comprises a waveform diagnosing circuit 253 for receiving an actual position signal from said signal input section 231 to perform a Fourier series expansion, such as fast Fourier transform, so as to make the frequency analysis of the actual position signal., and a learning circuit 254 for receiving the output signal from said waveform diagnosing circuit 253 and the target waveform signal from the target waveform signal generator 241 so as to optimize the control parameters (in concrete, the various coefficients of the control transfer function) in the filter circuit 251 on the basis of the deviation signal between these two waveform signals.

A digital signal processor or the like is used for said learning circuit 254. The learning circuit 254 delivers a signal which optimizes the control parameters in the filter circuit 251 in real time, for example, by selecting the original intrinsic frequency from a plurality of peak values mixed in the actual position signal to cancel the intrinsic frequency of the vibrating system of the mold 201. In addition, in this learning circuit 254, an algorithm applicable to an adaptive filter or the like is employed.

A learning decision making section 255 is interposed between the learning circuit 254 and the waveform diagnosing circuit 253 for making a decision as to whether or not the learning circuit 254 is to be used. For example, if a pattern different from the previous waveform is fed therein, a signal is delivered via the learning circuit 254.

The third control section 234 comprises a feedback control section 261 for receiving the actual position signal from the signal input section 231 to deliver a feedback control signal (PID control signal) and a feedback compensating signal (e.g., a compensating signal based on velocity and position signals), a second stepping cylinder compensating signal generator (second hydraulic compensating signal generator) 262 for receiving the position signal delivered from the feedback control section 261 to remedy the waveform disturbance caused by the operation delay of the stepping cylinder 205. Further, the deviation signal compensated in said second stepping cylinder compensating signal generator 262 is added to the target waveform signal subjected to said hydraulic and mechanical compensations.

In addition, the feedback control section 261 comprises a feedback control circuit 263 for making PID control, and a feedback compensating circuit 264 for delivering a compensating signal based on velocity and position signals. The feedback compensating circuit 264 is intended to stabilize the control system and improve the accuracy of control. In addition, said first stepping cylinder compensating signal generator 242 and mechanical compensating signal generator 243 cooperate with each other to make feed-forward compensation.

In the above arrangement, let $x_0$ be the target waveform signal delivered from the target waveform signal generator 241 for the mold 201, $(\Delta x_1)$ and $(\Delta x_2)$ be the compensating signals delivered from the first stepping cylinder compensating signal generator 242 and mechanical compensating signal generator 243, respectively, which constitute the feed-forward compensating circuit, and $\Delta x_0$ be the deviation signal feedback-controlled and compensated on the basis of the actual position signal from the signal input section 231 in the feedback control section 261 and second stepping cylinder compensating signal generator 262. Then, the signal fed into the pulse converter 235 is $(\Delta x_0+\Delta x_0+\Delta x_1+\Delta x_2)$.

After frequency analysis has been made by the waveform diagnosing circuit 253 of the second control section 233, the waveform signal from the signal input section 231 is fed into the learning decision making section 255, where a decision is made as to whether or not learning is required. If it is decided that learning is required, the waveform signal together with the target waveform signal from the target waveform signal generator 241 are fed into the learning circuit 254 and the deviation signal between the two waveform signals is calculated. In this case, predetermined calculations are made on the basis of this deviation signal by the algorithm used in the adaptive filter. For example, control parameters are delivered to the filter circuit 251 such that a deviation signal which is the difference between the peak value in the frequency characteristic of the waveform signal, i.e., resonance frequency (intrinsic frequency) and the target waveform signal is found and a waveform signal capable of cancelling the resonance frequency on the basis of said deviation signal is delivered. Therefore, it follows that in the actual vibrating state of the mold 201, the filter circuit 251 delivers a correcting waveform signal $(\Delta x_3)$ which cancels the intrinsic frequency.

Further, the feed-forward compensating circuit calculates the compensating signal $(\Delta x_1)$ for remedying the operation delay of the stepping cylinder 205 and the compensating signal $(\Delta x_2)$ for cancelling the signal transfer lag due to elastic deformation of the mechanical support structure. In addition, these compensating signals $(\Delta x_1)$ and $(\Delta x_2)$ are compensating components theoretically found such that the mold 201 produces the same waveform as the predetermined target vibration waveform, and they can be found as by the reciprocal of the transfer function between the input to the stepping cylinder 205 and the output from the mechanical support structure.

The control in the above arrangement will now be described in concrete.

First, in the stepping cylinder 205, the operation delay of the hydraulic system is compensated. That is, the movement of the rod 205*a* is controlled by controlling the movement of the valve and spool 224; however, in order for the rod 205*a* to move at a predetermined speed, it is necessary that the degree of opening of the valve be above a certain value. Therefore, an operation delay (phase lag) takes place between input and output. The input waveform is compensated in such a manner as to cancel such operation delay to ensure that the output waveform from the stepping cylinder 205 is the same in phase and waveform as the predetermined waveform.

As for the mechanical support structure, it is not a perfectly rigid body; thus, if the output waveform of the rod 205*a* of the stepping cylinder 205 contains higher components, such components cause the mechanical support structure, e.g., the link mechanism 203, to develop a resonance phenomenon. Particularly in the case where the signal waveform is a non-sinusoidal waveform, such as saw-tooth waveform, the target waveform signal itself contains a lot of higher components, tending to cause resonance.

Therefore, it is arranged that a waveform signal which contains a signal component which cancels the resonance of the mechanical support structure composed of the link mechanism 203 and table 202 is delivered from the stepping cylinder 205.

That is, said compensating signal ($\Delta x_1$) contains a signal component for remedying the operation delay produced by the stepping cylinder 205 and said compensating signal ($\Delta x_2$) contains a signal component for cancelling the resonance produced in the mechanical support structure, such as the link mechanism 203 and table 202.

In this manner, since feed-forward compensation is employed together with feedback control for correcting the amount of deviation from the target waveform signal in real time on the basis of the actual position of the mold 201, it is possible to dispense with the position sensor for detecting the position of the rod of a hydraulic cylinder as previously described with reference to the prior art example, and it is also possible to correct in real time the difference between the actual vibration waveform of the mold 201 and the target waveform, which could not be corrected by the feed-forward control alone. Therefore, highly accurate control which is little affected by disturbance can be effected.

Further, since the position sensor for detecting the position of the rod of the stepping cylinder can be dispensed with, it is no longer necessary to worry about a runaway of the stepping cylinder which could occur if the position sensor installed on the rod of the stepping cylinder were broken down.

In this third embodiment, it has been stated that the control parameters in the filter circuit 251 are optimized by the learning circuit 254 using the algorithm in the adaptive filter; however, it is possible, for example, to effect in real time the adjustment and optimization of the time constants in the individual stepping cylinder compensating sections and of the gain in the feedback control section (the feedback control circuit, feedback compensating circuit).

In this third embodiment, it has been stated that to detect the position, velocity and acceleration of the mold 201, use is made of the position sensor 228 which delivers position signals; however, an acceleration sensor may be used such that its acceleration signal is integrated once to provide the velocity signal and twice to provide the position signal. Further, the acceleration signal as such may be fed into the control unit or the velocity signal may be used. Further, both a position sensor and an acceleration sensor may be used.

In this third embodiment, it has been stated that the position sensor (displaced state detector) 228 is attached to the mold 201, however, it may be attached to the table 202. Further, as shown in phantom lines in FIG. 9, it may be attached to the end of the upper link 211. In this case, the waveform of the table estimated from the vibration waveform of the mold is used as the target waveform signal.

In this third embodiment, it has been stated that the algorithm in the adaptive filter is used for the adaptive control circuit however, instead of using such algorithm, use may be made of analyzing means using fuzzy logic or fast Fourier transform based on neural network, as shown in FIG. 11.

Further, in this third embodiment, it has been stated that vibrations are imparted to the mold through the table and link mechanism; however, one or more stepping cylinders may be directly connected to the table supporting the mold. In addition, in this case, the table will be considered as a mechanical support structure for signal transfer.

A mold vibrating apparatus according to a fourth embodiment of the invention will now be described with reference to FIGS. 12 through 14.

Figure 12:
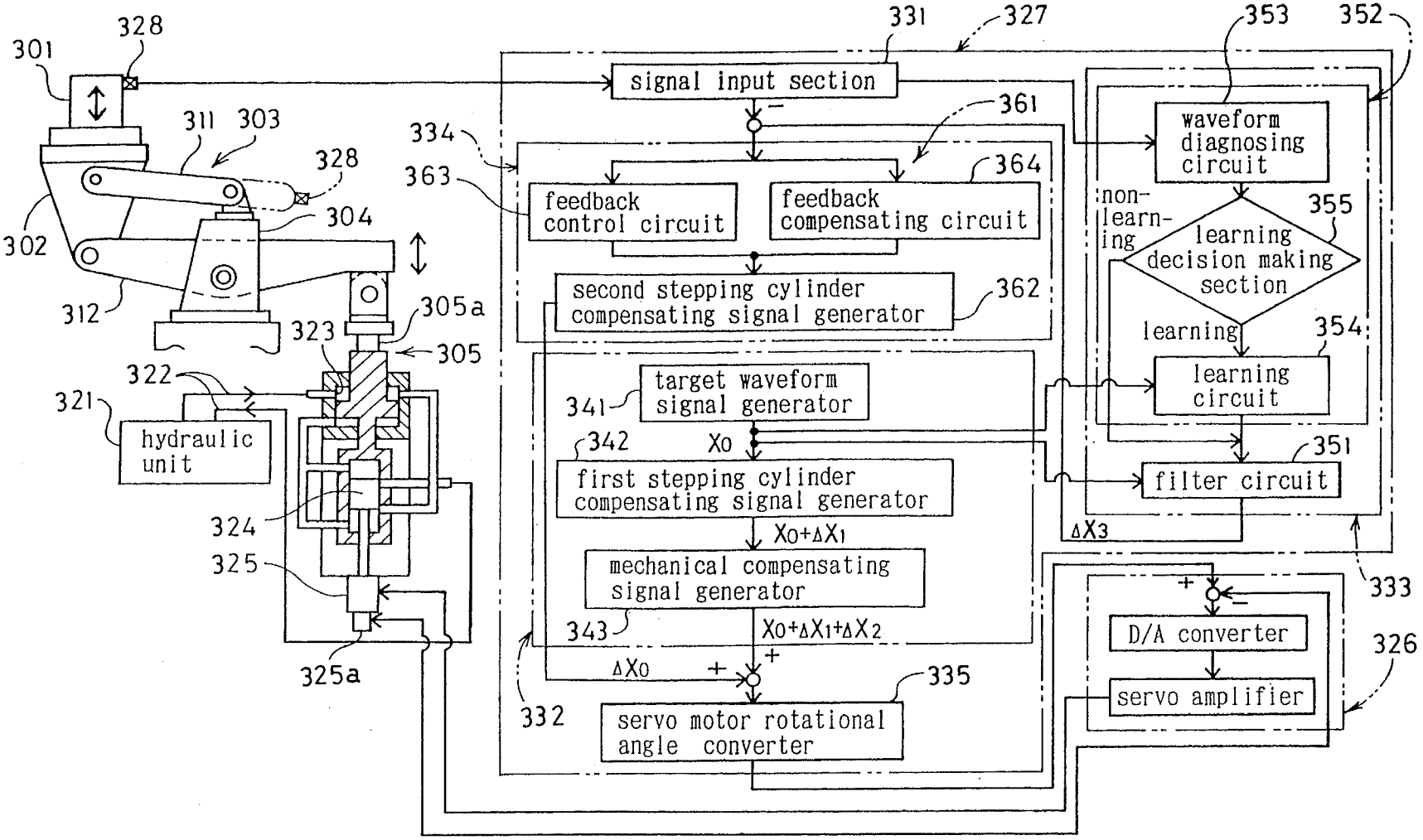
FIG. 12 is a view showing the entire arrangement of a mold vibrating apparatus according to a fourth embodiment of the invention.
Figure 13:
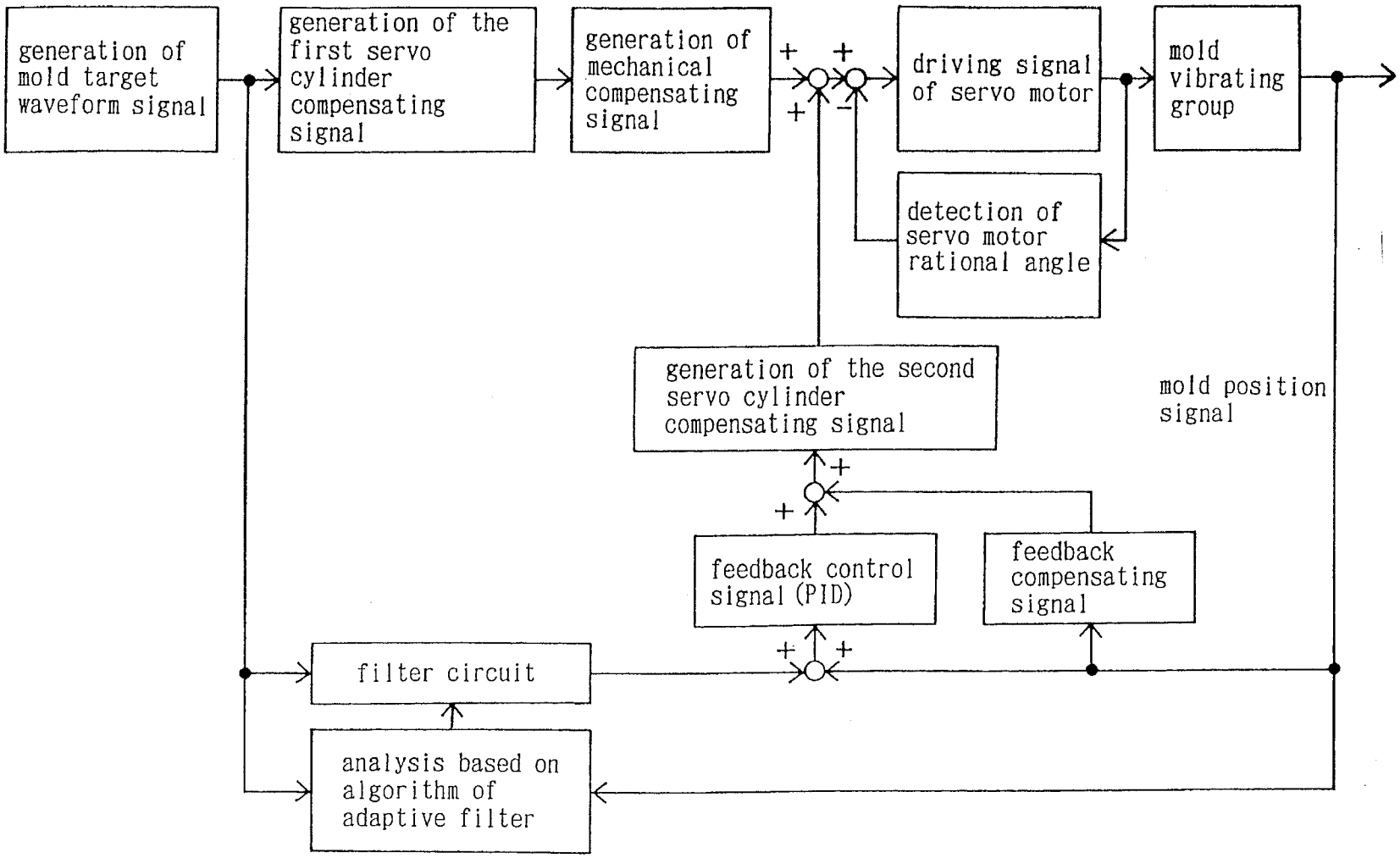
FIG. 13 is a block diagram showing the operation of the principal portion of the mold vibrating apparatus according to the fourth embodiment.
Figure 14:
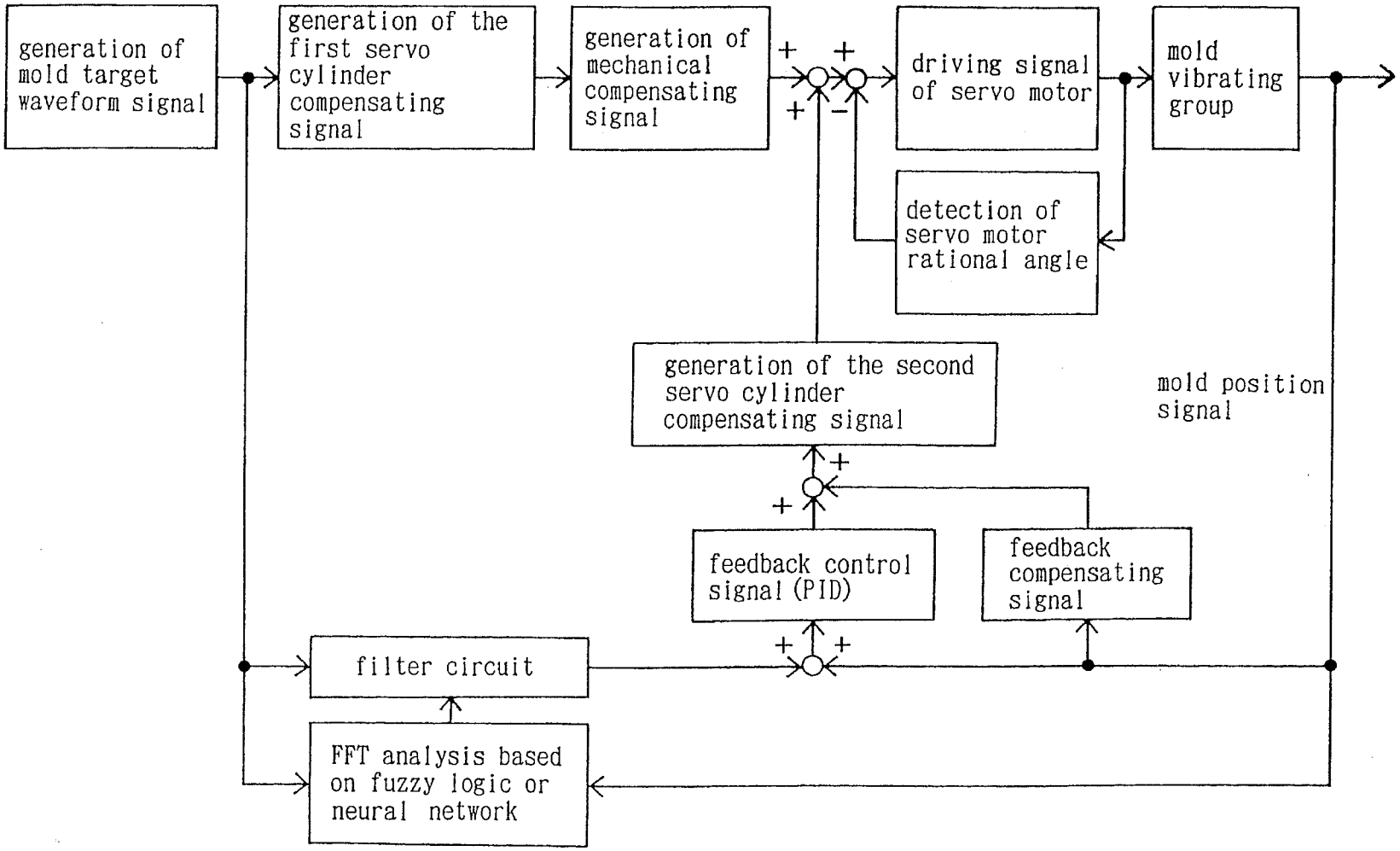
FIG. 14 is a block diagram showing the operation of the principal portion of a modification of the mold vibrating apparatus according to the fourth embodiment.

FIGS. 12 and 13 correspond to claims 13 and 14 and FIG. 14 corresponds to claims 15 and 16.

The point which differs from the third embodiment is that the cylinder device for imparting vibrations to the mold is an electrohydraulic stepping cylinder in the third embodiment but in the fourth embodiment it is an electrohydraulic servo cylinder.

In FIG. 12 and 13, the numeral 301 denotes a mold in continuous molding equipment, said mold being placed on a table 302. And, this mold 301 is supported for swing movement in a vertical plane with respect to a support block 304 through the table 302 and a link mechanism 303 and is vertically vibrated by a electrohydraulic servo cylinder 305 connected to said link mechanism 303.

The link mechanism 303 comprises an upper link 311 and a lower link 312. The upper and lower links 311 and 312 are pin-connected at one of their respective ends to the table 302. Further, the other end of said upper link 311 and the intermediate portion of said lower link 312 are supported by the support block 304 through pins, and the other end of said lower link 312 is pin-connected to the rod 305*a* of said servo cylinder 305.

Connected to said servo cylinder 305 through a hydraulic pipes 322 is a hydraulic unit 321 for feeding hydraulic fluid. Further, there are an electric servo motor (driving section) 325 which moves a spool 324 for feeding successive predetermined amounts of hydraulic fluid from the hydraulic unit 321 to a cylinder chamber 323, and a drive unit 326 comprising a servo amplifier for driving said servo motor 325.

And there is a control unit 327 for controlling the drive unit 326 of the servo motor 325. This control unit 327 comprises a signal input section 331 having an A/D converter attached to the mold 301 and receiving an actual mold position signal (which is an example of displaced state signal, thereinafter referred to simply as the actual position signal) from a position sensor (displaced state detector) 328 for detecting the displaced state, e.g., vibrating position of the mold 301, said converter converting said actual position signal into a digital signal, a first control section 332 for generating a target waveform signal for the mold, a second control section 333 for delivering a correcting waveform signal for smoothing the gain in the frequency characteristic thereof to the position signal from the signal input section 331, a third control section 334 for obtaining a deviation signal by subtracting the correcting waveform signal from the second control section 333 from the actual position signal for the mold, calculating a predetermined feedback control signal on the basis of said deviation signal, and adding this feedback control signal to the output signal from the first control section 332, and a servo motor rotational angle converter 335 for receiving a drive signal obtained by adding the output signals from the two control sections 332 and 334 so as to deliver a rotational angle signal to the drive unit 326.

The first control section 332 comprises a target waveform signal generator 341 for generating a target waveform signal for vibrating the mold 301, a first servo cylinder compensating signal generator (first hydraulic compensating signal generator) 342 for adding to the target waveform signal delivered from said target waveform signal generator 341 a compensating waveform signal for remedying the waveform disturbance caused by the operation delay (e.g., delay due to switching of valves, and compression of oil) of the servo cylinder 305, and a mechanical compensating signal generator (for example, compensation of acceleration of the mold is made) 343 for adding a compensating waveform signal for cancelling the motion transfer lag due to elastic deformation of the mechanical support structure including the link mechanism 303 and table 302.

The second control section 333 is provided with a filter circuit 351 for receiving the target waveform signal from the target waveform signal generator 341 to deliver a correcting waveform signal (in concrete, a waveform signal for cancelling the intrinsic frequency of the mold vibrating system) for smoothing the gain in the frequency characteristic thereof in accordance with said target waveform signal, an adaptive control circuit 352 for optimizing the characteristics in said filter circuit 351, i.e., the control parameters in real time in accordance with the actual vibrating state of the mold 301. As for said filter circuit 351, use is made, e.g., of a target value filter or a notch filter.

The adaptive control circuit 352 comprises a waveform diagnosing circuit 353 for receiving an actual position signal from said signal input section 331 to perform a Fourier series expansion, such as fast Fourier transform, so as to make the frequency analysis of the actual position signal, and a learning circuit 354 for receiving the output signal from said waveform diagnosing circuit 353 and the target waveform signal from the target waveform signal generator 341 so as to optimize the control parameters (in concrete, the various coefficients of the control transfer function) in the filter circuit 351 on the basis of the deviation signal between these two waveform signals.

A digital signal processor or the like is used for said learning circuit 354. The learning circuit 354 delivers a signal which optimizes the control parameters in the filter circuit 351 in real time by selecting the original intrinsic frequency from a plurality of peak values mixed in the actual position signal to cancel the intrinsic frequency of the vibrating system of the mold 301. In addition, in this learning circuit 354, an algorithm applicable to an adaptive filter or the like is employed.

A learning decision making section 355 is interposed between the learning circuit 354 and the waveform diagnosing circuit 353 for making a decision as to whether or not the learning circuit 354 is to be used. For example, if a pattern different from the previous waveform is fed thereinto, a signal is delivered via the learning circuit 354.

The third control section 334 comprises a feedback control section 361 for receiving the actual position signal from the signal input section 331 to deliver a feedback control signal (PID control signal) and a feedback compensating signal (e.g., a compensating signal based on velocity and position signals), a second servo cylinder compensating signal generator (second hydraulic compensating signal generator) 362 for receiving the position signal delivered from the feedback control section 361 to remedy the waveform disturbance caused by the operation delay of the servo cylinder 305. Further, the deviation signal compensated in said second servo cylinder compensating signal generator 362 is added to the target waveform signal subjected to said hydraulic and mechanical compensations.

In addition, the feedback control section 361 comprises a feedback control circuit 363 for making PID control, and a feedback compensating circuit 364 for delivering a compensating signal based on velocity and position signals. The feedback compensating circuit 364 is intended to stabilize the control system and improve the accuracy of control.

Said drive unit 326 comprises a D/A converter 371 for converting into a digital signal the rotational angle signal delivered from the servo motor rotational angle converter 335, and a servo amplifier 3? 2 for amplifying the output signal from said D/A converter 371, the arrangement being such that the actual rotational angle of the servo motor 325 is detected by the angle detector **325*a* installed on the servo motor 325 and the thus-detected rotational angle signal is fed back to the control signal to be fed into the servo amplifier 372. In addition, said first servo cylinder compensating signal generator 342 and mechanical compensating signal generator 343** cooperate with each other to make feed-forward compensation.

In the above arrangement, let $x_0$ be the target waveform signal delivered from the target waveform signal generator 341 for the mold 301, $(\Delta x_1)$ and $(\Delta x_2)$ be the compensating signals delivered from the first servo cylinder compensating signal generator 341 and mechanical compensating signal generator 343, respectively, which constitute the feed-forward compensating circuit, and $(\Delta x_0)$ be the deviation signal controlled and compensated on the basis of the actual position signal from the signal input section 331 in the feedback control section 361 and second servo cylinder compensating signal generator 362. Then, the signal fed into the servo motor rotational angle converter 335 is $(x_0+\Delta x_0+\Delta x_1+\Delta x_2)$.

After frequency analysis has been made by the waveform diagnosing circuit 353 of the second control section 333, the waveform signal from the signal input section 331 is fed into the learning decision making section 355, where a decision is made as to whether or not learning is required. If it is decided that learning is required, the waveform signal together with the target waveform signal from the target waveform signal generator 341 are fed into the learning circuit 354 and the deviation signal between the two waveform signals is calculated. In this case, predetermined calculations are made on the basis of this deviation signal by the algorithm used in the adaptive filter. For example, control parameters are delivered to the filter circuit 351 such that a deviation signal which is the difference between the peak value in the frequency characteristic of the actual waveform signal, i.e., resonance frequency (intrinsic frequency) and the target waveform signal is found and a waveform signal capable of cancelling the resonance frequency on the basis of said deviation signal is delivered. Therefore, it follows that in the actual vibrating state of the mold 301, the filter circuit 351 delivers a correcting waveform signal ($\Delta x_3$) which cancels the intrinsic frequency.

Further, the feed-forward compensating circuit calculates the compensating signal ($\Delta x_1$) for remedying the operation delay of the servo cylinder 305 and the compensating signal ($\Delta x_2$) for cancelling the signal transfer lag due to elastic deformation of the mechanical support structure. In addition, these compensating signals ($\Delta x_1$) and ($\Delta x_2$) are compensating components theoretically found such that the mold 301 produces the same waveform as the predetermined target vibration waveform, and they can be found as by the reciprocal of the transfer function between the input to the servo cylinder 305 and the output from the mechanical support structure.

The control in the above arrangement will now be described in concrete.

First, in the servo cylinder 305, the operation delay of the hydraulic system is compensated. That is, the movement of the rod 305*a* is controlled by controlling the movement of the valve and spool 324; however, in order for the rod 305*a* to move at a predetermined speed, it is necessary that the degree of opening of the valve be above a certain value. Therefore, an operation delay (phase lag) takes place between input and output. The input waveform is compensated in such a manner as to cancel such operation delay to ensure that the output waveform from the servo cylinder 305 is the same in phase and waveform as the predetermined waveform.

As for the mechanical support structure, it is not a perfectly rigid body; thus, for example, if the output waveform of the rod 305*a* of the servo cylinder 305 contains higher components, such components cause the mechanical support structure, e.g., the link mechanism 303, to develop a resonance phenomenon. Particularly in the case where the signal waveform is a non-sinusoidal waveform, such as saw-tooth waveform, the target waveform signal itself contains a lot of higher components, tending to cause resonance.

Therefore, it is arranged that a waveform signal which contains a signal component which cancels the resonance of the mechanical support structure composed of the link mechanism 303 and table 302 is delivered from the servo cylinder 305.

That is, said compensating signal ($\Delta x_1$) contains a signal component for remedying the operation delay caused by the servo cylinder 305 and said compensating signal ($\Delta x_2$) contains a signal component for cancelling the resonance produced in the mechanical support structure, such as the link mechanism 303 and table 302.

In this manner, since feed-forward compensation is employed together with feedback control for correcting the amount of deviation from the target waveform signal in real time on the basis of the actual position of the mold 301, it is possible to dispense with the position detecting sensor for detecting the position of the rod of a hydraulic cylinder as previously described with reference to the prior art example, and it is also possible to correct in real time the difference between the actual vibration waveform of the mold 301 and the target waveform, which could not be corrected by the feed-forward control alone. Therefore, highly accurate control which is little affected by disturbance can be effected.

Further, since the position sensor for detecting the position of the rod of the servo cylinder can be dispensed with, it is no longer necessary to worry about a runaway of the servo cylinder which could occur if the position sensor installed on the rod of the servo cylinder were broken down.

In this fourth embodiment, it has been stated that in order to detect the position, velocity and acceleration of the mold 301, the position sensor 328 is used which delivers position signals; however, an acceleration sensor may be used such that its acceleration signal is integrated once to provide the velocity signal and twice to provide the position signal. Further, the acceleration signal as such may be fed into the control unit or the velocity signal may be used. Further, both a position sensor and an acceleration sensor may be used.

In this fourth embodiment, it has been stated that the position sensor (displaced state detector) 328 is attached to the mold 301; however, it may be attached, for example, to the table 302 or, as shown in phantom lines in FIG. 12, it may be attached to the end of the upper link 312. In this case, the waveform of the table estimated from the vibration waveform of the mold is used as the target waveform signal.

In this connection, in the fourth embodiment, it has been stated that the algorithm in the adaptive filter is used for the adaptive control circuit; however, instead of using such algorithm, use may be made of analyzing means using fuzzy logic or fast Fourier transform based on neural network, as shown in FIG. 14.

Further, in this fourth embodiment, it has been stated that vibrations are imparted to the mold through the table and link mechanism; however, a servo cylinder may be directly connected to the table supporting the mold. In addition, in this case, the table will be considered as a mechanical support structure for signal transfer.

What is claimed is:

1. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal from said mechanical compensating signal generator a stepping cylinder compensating waveform signal for remedying the waveform disturbance caused by the operation delay of said electrohydraulic stepping cylinder, and a feedback signal generator for receiving a displaced state signal from a displaced state detector which detects the displaced state of said mold, calculating the difference between said displaced state signal and a target displaced state signal obtained from said target waveform signal generator, and adding the deviation signal obtained by this subtraction to the waveform signal delivered from said mechanical compensating signal generator.

2. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal delivered from said mechanical compensating signal generator a stepping cylinder compensating waveform signal for remedying the waveform disturbance caused by the operation delay of said electrohydraulic stepping cylinder, and a feedback signal generator for receiving a displaced state signal from a displaced state detector which detects the displaced state of said mold, calculating the difference between said displaced state signal and a target displaced state signal obtained from said target waveform signal generator, and adding the deviation signal obtained by this subtraction to the target waveform signal delivered from said target waveform signal generator.

3. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal from said mechanical compensating signal generator a stepping cylinder compensating waveform signal for remedying the waveform disturbance caused by the operation delay of said electrohydraulic stepping cylinder, and a feedback signal generator for receiving a position signal from a position detector which detects the position of said mold, calculating the difference between said position signal and a target position signal obtained from said target waveform signal generator, and adding the deviation signal obtained by this subtraction to the waveform signal delivered from said mechanical compensating signal generator.

4. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic stepping cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal delivered from said mechanical compensating signal generator a stepping cylinder compensating waveform signal for remedying the waveform disturbance caused by the operation delay of said electrohydraulic stepping cylinder, and a feedback signal generator for receiving a position signal from a position detector which detects the position of said mold, calculating the difference between said position signal and a target position signal obtained from said target waveform signal generator, and adding the deviation signal obtained by this subtraction to the target waveform signal delivered from said target waveform signal generator.

5. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic servo cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal from said mechanical compensating signal generator a cylinder compensating waveform signal for remedying the waveform disturbance caused by the operation delay of said electrohydraulic servo cylinder, and a feedback signal generator for receiving a displaced state signal from a displaced state detector which detects the displaced state of said mold, calculating the difference between said displaced state signal and a target displaced state signal obtained from said target waveform signal generator, and adding the deviation signal obtained by this subtraction to the waveform signal delivered from said mechanical compensating signal generator.

6. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic servo cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal delivered from said mechanical compensating signal generator a cylinder compensating waveform signal for remedying the waveform disturbance caused by the operation delay of said electrohydraulic servo cylinder, and a feedback signal generator for receiving a displaced state signal from a displaced state detector which detects the displaced state of said mold, calculating the difference between said displaced state signal and a target displaced state signal obtained from said target waveform signal generator, and adding the deviation signal obtained by this subtraction to the target waveform signal delivered from said target waveform signal generator.

7. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic servo cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal from said mechanical compensating signal generator a cylinder compensating waveform signal for remedying the waveform disturbance caused by the operation delay of said electrohydraulic servo cylinder, and a feedback signal generator for receiving a position signal from a position detector which detects the position of said mold, calculating the difference between said position signal and a target position signal obtained from said target waveform signal generator, and adding the deviation signal obtained by this subtraction to the waveform signal delivered from said mechanical compensating signal generator.

8. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic servo cylinder is used as said cylinder device, said control unit comprises a target waveform signal generator for generating a target waveform signal for the mold, a mechanical compensating signal generator for adding to the target waveform signal delivered from said target waveform signal generator a mechanical compensating waveform signal for cancelling a motion transfer lag caused by elastic deformation of said support structure, a hydraulic compensating signal generator for adding to the waveform signal delivered from said mechanical compensating signal generator a cylinder compensating waveform signal For remedying the waveform disturbance caused by the operation delay of said electrohydraulic servo cylinder, and a feedback signal generator for receiving a position signal from a position detector which detects the position of said mold, calculating the difference between said position signal and a target position signal obtained from said target waveform signal generator, and adding the deviation signal obtained by this subtraction to the target waveform signal delivered from said target waveform signal generator.

9. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic stepping cylinder is used as said cylinder device, said control unit comprises a target waveform signal generator for generating a target waveform signal for the mold, a first hydraulic compensating signal generator for adding to the target waveform signal delivered from said target waveform signal generator a cylinder compensating waveform signal for remedying the waveform disturbance caused by the operation delay of said electrohydraulic stepping cylinder, a mechanical compensating signal generator for adding to the waveform signal from said first hydraulic compensating signal generator a mechanical compensating waveform signal for cancelling a motion transfer lag caused by elastic deformation of said support structure, a filter circuit for receiving the target waveform signal from said target waveform signal generator to deliver a correcting waveform signal for averaging the gain in the frequency characteristic thereof, an adaptive control circuit for controlling the control coefficient in said filter circuit to provide an optimum value according to the deviation signal between said target waveform signal and the displaced state signal, a feedback control section for generating a feedback control signal on the basis of the deviation signal obtained by subtracting the correction waveform signal delivered from said filter circuit from the displaced state signal from said displaced state detector, and a second hydraulic compensating signal generator for adding a hydraulic compensating signal to the feedback control signal from said feedback control section, the arrangement being such that the deviation signal having the output signal from said second hydraulic compensating signal generator added thereto is added to the waveform signal delivered from said mechanical compensating signal generator.

10. A mold vibrating apparatus in continuous casting equipment, as set forth in claim 9, characterized in that an algorithm applicable to an adaptive filter is used for an adaptive control circuit.

11. A mold vibrating apparatus in continuous casting equipment, as set forth in claim 9, characterized in that fuzzy logic is used for an adaptive control circuit.

12. A mold vibrating apparatus in continuous casting equipment, as set forth in claim 9, characterized in that analyzing means using fast Fourier transform based on neural network is used for an adaptive control circuit.

13. A mold vibrating apparatus in continuous casting equipment including a support structure for mechanically supporting the mold, a cylinder device for applying vibrations to the mold through said support structure, a hydraulic unit for feeding hydraulic fluid into said cylinder device through a hydraulic circuit, and a control unit for delivering a driving signal to a driving section for said cylinder device, said mold vibrating apparatus being characterized in that:

an electrohydraulic servo cylinder is used as said cylinder device, said control unit comprises a target waveform signal generator for generating a target waveform signal for the mold, a first hydraulic compensating signal generator for adding to the target waveform signal delivered from said target waveform signal generator a cylinder compensating waveform signal for remedying the waveform disturbance caused by the operation delay of said electrohydraulic servo cylinder, a mechanical compensating signal generator for adding to the waveform signal from said first hydraulic compensating signal generator a mechanical compensating waveform signal for cancelling a motion transfer lag caused by elastic deformation of said support structure, a filter circuit for receiving the target waveform signal from said target waveform signal generator to deliver a correcting waveform signal for averaging the gain in the frequency characteristic thereof, an adaptive control circuit for controlling the control coefficient in said filter circuit to provide an optimum value according to the deviation signal between said target waveform signal and the displaced state signal, a feedback control section for generating a feedback control signal on the basis of the deviation signal obtained by subtracting the correction waveform signal delivered from said filter circuit from the displaced state signal from said displaced state detector, and a second hydraulic compensating signal generator for adding a hydraulic compensating signal to the feedback control signal from said feedback control section, the arrangement being such that the deviation signal having the output signal from said second hydraulic compensating signal generator added thereto is added to the waveform signal delivered from said mechanical compensating signal generator.

14. A mold vibrating apparatus in continuous casting equipment, as set forth in claim 13, characterized in that an algorithm applicable to an adaptive filter is used for an adaptive control circuit.

15. A mold vibrating apparatus in continuous casting equipment, as set forth in claim 13, characterized in that fuzzy logic is used for an adaptive control circuit.

16. A mold vibrating apparatus in continuous casting equipment, as set forth in claim 13, characterized in that analyzing means using fast Fourier transform based on neural network is used for an adaptive control circuit.

* * * * *